United States Patent [19]

Miyasaka et al.

[11] Patent Number: 4,820,606

[45] Date of Patent: Apr. 11, 1989

[54] SILVER HALIDE PHOTOGRAPHIC MATERIAL

[75] Inventors: Tsutomu Miyasaka; Masaki Okazaki; Tadao Sugimoto, all of Kanagawa, Japan

[73] Assignee: Fuji Photo Film Co., Ltd., Kanagawa, Japan

[21] Appl. No.: 127,137

[22] Filed: Dec. 1, 1987

[30] Foreign Application Priority Data

Dec. 1, 1986 [JP] Japan ..... 61-284271

[51] Int. Cl.[4] ..... G03C 1/12; G03C 1/28

[52] U.S. Cl. ..... 430/139; 430/570; 430/572; 430/573; 430/574; 430/576

[58] Field of Search ..... 430/139, 570, 572, 573, 430/574, 576

[56] References Cited

U.S. PATENT DOCUMENTS

| | | | |
|---|---|---|---|
| 2,865,744 | 12/1958 | Friedman et al. | 430/139 |
| 3,622,316 | 11/1971 | Bird et al. | 430/574 |
| 4,040,825 | 8/1977 | Steiger et al. | 430/570 |
| 4,543,308 | 9/1985 | Schumann et al. | 430/139 |

OTHER PUBLICATIONS

Meier, *Spectral Sensization,* 1968, Focal Press, New York, pp. 83 & 84.

*Primary Examiner*—Richard L. Schilling

*Attorney, Agent, or Firm*—Sughrue, Mion, Zinn, Macpeak and Seas

[57] ABSTRACT

A silver halide photographic material having at least one silver halide emulsion layer having been spectrally sensitized with adsorbable spectral sensitizing dye is disclosed, wherein a hydrophilic dispersion medium contains a substantially non-adsorbable luminescent dye which is easily removable by development processing the satisfies the following conditions (1) to (3):

(1) The luminescent dye has an equilibrium adsorption of not more than $5\times10^{-7}$ mol per $m^2$ of silver bromide grain surface in a 5% by weight gelatin aqueous solution containing silver bromide grains whose outer surface is composed substantially of a [111] face under conditions of 40° C. in temperature, $6.5\pm0.05$ in pH, and $10^{-4}$ mol/l in dye concentration in the solution phase;

(2) The luminescent dye has an emission quantium yield of not less than 0.1 at room temperature in dry gelatin at a concentration of $10^{-4}$ mol/$dm^3$; and (3) The luminescent dye has an emission band at least a part of which overlaps an optical absorption band of the absorbable spectral sensitizing dye on silver halide grains. Use of the non-adsorbable luminescent dye markedly improves spectral sensitivity of the silver halide photographic material without causing desensitization.

15 Claims, No Drawings

SILVER HALIDE PHOTOGRAPHIC MATERIAL

FIELD OF THE INVENTION

This invention relates to a novel technique for spectral sensitization of silver halide photographic materials. More particularly, it relates to a silver halide photographic material having markedly improved spectral sensitivity in which a strongly luminescent and substantially non-adsorbable dye is incorporated in high concentration in a dispersion medium of a light-sensitive silver halide emulsion spectrally sensitized with an adsorbable dye.

This invention relates to a basic technique covering the whole field of silver halide photographic materials and applicable to all silver halide photographic materials including negative, positive, and reversal type black-and-white and color photographic materials.

BACKGROUND OF THE INVENTION

Spectral sensitization of silver halides with sensitizing dyes is a well-known technique. Generally employed dyes for spectral sensitization include methine dyes, such as cyanine, merocyanine, complex cyanine, and complex merocyanine dyes, etc. These dyes may be used in combinations thereof for the purpose of expansion of a color sensitive wavelength region or supersensitization.

Any of these sensitizing dyes is required to have adsorbability onto silver halide grain surfaces to function as a dye of electron injection type. On the other hand, however, it is known that the sensitizing dyes have their limit in adsorption to silver halide grain surfaces, and adsorption to saturation or near saturation often results in serious desensitization (inherent desensitization), as described, e.g., in W. C. Lewis et al., *Photographic Science and Engineering,* Vol. 13, p. 54 (1969). Moreover, surface coating of silver halide grains with the sensitizing dyes is sometimes accompanied by problems, such as development inhibition. Under the present invention, therefore, the individual silver halide grains exhibit an extremely low rate of absorption (utilizing efficiency) of incident photons in the spectral sensitization region.

Bird et al. proposed to increase the quantity of absorbed photons by having plural dyes adsorbed on silver halide to form multiple layers as disclosed in U.S. Pat. No. 3,622,316 or by having sensitizing dye molecules containing plural cyanine chromophoric groups adsorbed on silver halide as disclosed in U.S. Pat. No. 3,622,317, to thereby effect sensitization utilizing Forster type excited energy transfer. However, these techniques still undergo the aforesaid limitation of adsorption surface area and the disadvantages due to inherent desensitization and attain virtually no substantial positive effects.

Steiger et al. proposed a sensitization technique in which a fluorescent dye, such as a cyanine dye, a xanthene dye, etc., is chemically bonded to colloidal molecules of a dispersion medium, such as gelatin, and the dye bound to, e.g., gelatin, excites the dye adsorbed on the silver halide surfaces or a spectral sensitizing dye of a different kind through Förster type energy transfer [cf. *Th. Forster, Disc. Faraday Soc.,* Vol. 27, 7 (1959)] or optical absorption of luminescence emitted from the dye bound to gelatin as disclosed in *Photo. Sci. Eng.,* Vol. 27, 59 (1983) and Japanese Patent Application (OPI) No. 117619/76 (the term "PI" as used herein means "unexamined published Japanese patent application").

This technique differs from the system of Bird et al. in that a dye which is not directly adsorbed on silver halide grains also contributes to sensitization. However, since the sensitizing dye to be dispersed in a medium according to the method of Steiger et al. naturally exhibits strong adsorbability, a part of the dye bonded to gelatin is also adsorbed directly on the silver halide grains and thereby acts as an energy acceptor. As a result, it is generally difficult to realize ideal overlapping of the luminescence band by the non-adsorbed dye and the absorption band by the adsorbed dye.

This difficulty greatly bars highly efficient energy transmission, because energy transmission essentially requires, in principal, an overlap of a luminescence band and an absorption band, whether it is effected by Forster type energy transfer or reabsorption of luminescence. Besides, when the dye to be used is of such a type that adsorption onto the silver halide grains brings about desensitization, the above-described method cannot be applied. Further, this method involves complicated steps, such as synthesis or purification of a dye capable of being bonded to a dispersion medium, entailing greatly increased production cost.

Moreover, in carrying out this method, it is necessary to use a light-harvesting dye in high concentration. However, the rate of reaction between the dye and dispersion medium molecules has its limit. Even if a high rate of reaction may be achieved, functional groups for hardening wuuld be lost upon reacting, so that a sufficient degree of hardening is hardly obtained. Because of these restrictions on their practical use, there is a limit in concentration of the dye to be added.

Further, the freedom for synthesis and selection of the aforesaid luminescent dye materials capable of being bonded to a dispersion medium is far narrower in scope than that permitted in the technique of the present invention in which an optional amount of a water-soluble luminescent dye is merely added and dispersed in a hydrophilic medium.

The luminescent dye is required to almost completely decolorize during photographic processing. However, that is impossible or needs a special processing step when the dye is chemically bound to the medium.

The above-described sensitization method of utilizing dye adsorption in multiple layers and the method of using a dye bound to a binder both lack the ability to increase sensitization efficiency by separating the function of a spectral sensitizing dye (electron injection type) in an adsorbed state from the function of a light-harvesting dye of the energy transmission type on their functions. These methods are also disadvantageous in that a complicated synthesis of the dye is involved or general development processing is inapplicable.

SUMMARY OF THE INVENTION

Accordingly, one object of this invention is to provide a silver halide photographic material having improved color sensitivity by using a non-adsorbable light-harvesting dye in combination with an adsorbable spectral sensitizer.

Another object of this invention is to provide a silver halide photographic material which provids a satisfactory photographic image by using a non-adsorbable light-harvesting dye without causing desensitization attributed to inherent desensitization, development inhibition, and the like.

A further object of this invention is to provide a silver halide photographic material which is entirely free from color remaining after development of the imagewise exposed photographic film by using a non-adsorbable and highly water-soluble light-harvesting dye which can be washed off nearly completely when processed not only during general development processing, but also during rapid development processing.

As a result of extensive investigations, it has now been found that the efficiency of sensitization by light-harvesting can be improved markedly by clearly separating the condensing function of a light-harvesting dye from the sensitizing function on silver halide grains by using a luminescent dye which is not substantially adsorbed on silver halide and satisfies given conditions hereinafter described and that such a luminescent dye can easily be decolored through development processing without requiring any special step. The present invention has been completed based on these findings.

Thus, the above-described objects of this invention can be accomplished by using a silver halide photographic material having at least one silver halide emulsion layer having been spectrally sensitized with an adsorbable spectral sensitizing dye, wherein a hydrophilic dispersion medium contains a substantially non-adsorbable luminescent dye which is easily removable by development processing and satisfies the following conditions (1) to (3):

(1) The luminescent dye has an equilibrium adsorption of not more than $5\times10^{-7}$ mol per $m^2$ of silver bromide grain surface in a 5% by weight gelatin aqueous solution containing silver bromide grains whose outer surface is composed substantially of a [111] face under conditions of 40° C. in temperature, 6.5±0.05 in pH, and $10^{-4}$ mol/l in dye concentration in the solution phase;

(2) The luminescent dye has an emission quantum yield of not less than 0.1 at a concentration of $10^{-4}$ mol/$dm^3$ in dry gelatin at room temperature; and (3) The luminescent dye has an emission band at least a part of which overlaps an optical absorption band of the adsorbable spectral sensitizing dye on silver halide grains.

DETAILED DESCRIPTION OF THE INVENTION

The luminescent dye (hereinafter sometimes referred to as light-harvesting dye) which can be used in the present invention has high water solubility and substantial nonadsorbability by silver halide grains. The terminology "substantial non-adsorbability" as used herein means that the adsorption on an outer surface of a [111] face of silver bromide crystals is not more than $5\times10^{-7}$ mol/$m^2$ in a 5% by weight gelatin aqueous solution at a temperature of 40° C., at a pH of 6.5±0.05, and at an equilibrium concentration of $10^{-4}$ mol/l. An adsorption of not more than $10^{-7}$ mol/$m^2$ under such conditions is preferred. The adsorption of a dye can be determined by, for example, a method comprising adding the dye to an emulsion containing 5% by weight of gelatin, stirring the system at 40° C. for 18 hours under a safelight, separating silver halide grains by centrifugal sedimentation, and measuring the dye concentration in the supernatant liquor. While the adsorption of the light-harvesting dye according to the present invention is defined with respect to adsorption onto silver bromide, it is desirable that such a low level of adsorption is also met with respect to adsorption onto silver halides containing iodine or chlorine.

The non-adsorbable luminescent (light-harvesting) dye of the present invention preferably has sufficiently high water solubility, usually of not less than $10^{-2}$ mol/l at 25° C. and a pH of 7.0. Such high water solubility can be achieved by, for example, the existence of at least four water-soluble groups per molecule. The water-soluble groups preferably include a sulfo group and a carboxyl group. Existence of at least 4 of such anionic hydrophilic groups in the dye molecule assures high water solubility as well as substantial non-adsorbability on silver halide grains. Owing to the high water solubility and substantial non-adsorbability, the dye of the invention can be dispersed in a hydrophilic colloid of an emulsion layer in high concentration and also removed rapidly and completely through washing. Although the water-soluble and substantially nonadsorbable light-harvesting dyes to be used are not limited by the above-described molecular structure, i.e., existence of at least four water-soluble groups, the dyes which can be used in this invention preferably include cyanine dyes-in view of the easiness for introduction of water-soluble groups in their synthesis and the excellent luminescence efficiency.

The light-harvesting dye to be used is required to have an emission quantum yield of not less than 0.1, preferably not less than 0.3, and more preferably not less than 0.5, at a concentration of $10^{-4}$ mol/$dm^3$ in a dry gelatin medium at room temperature.

The emission quantum yield of the light-harvesting dye in a dry film can be determined basically in the same manner as for measurement of emission quantum yields in solutions. In general, it is obtained by a relative measurement method in which each of an incident light intensity, an extinction modulus of a sample, and an emission intensity of a sample is compared with the corresponding value of a standard substance whose absolute quantum yield is known (e.g., Rhodamine B, quinine sulfate, 9,10-diphenylanthracene, etc.) with an optical arrangement being the same. Reference can be made to, e.g., in C. A. Parker and W. T. Rees, *Analyst*, Vol. 85, p. 587 (1960) for information as to the absolute quantum yield.

The emission quantum yield of the light-harvesting dye in dry gelatin can, therefore, be obtained conveniently through the aforesaid relative measurement using, as a reference substance, a dry gelatin film having dispersed therein a standard luminescent dye at an arbitrary concentration, whose absolute quantum yield is known. In the present invention, the absolute emission quantum yield of a standard sample in a dry film was determined as follows.

Fluorescent N-phenyl-1-naphthylamine-8-sulfonic acid which does not contribute to reabsorption due to an overlap of an absorption band and an emission band was chosen as a standard dye. Gelatin containing this standard dye was uniformly coated on a transparent support and dried to prepare a standard sample having a dye concentration (in a dry film) of $10^{-2}$ mol/$dm^3$ and a gelatin coverage of 6 g/$m^2$. Thereafter, the sample was set in an integrating sphere whose inner wall had been coated with a white powder of barium sulfate. A monochromatic exciting light of 380 nm was irradiated on the sample, and the intensities of the exciting light and fluorescence were detected by a photomultiplier set at the window of the integrating sphere. At this time, a percent absorption (A) of the sample was determined by comparing the intensity of exciting light with the sample being set with that with no sample being set, as detected by the photomultiplier through a fluorescence-cut filter. On the other hand, the integrated fluorescent intensity (F') of the fluorescence from the sample was determined by using an exciting light-cut filter. Then, the intensity of a monochromatic incident light (I') was measured under the same measurement system as for F', but with neither a sample nor a filter being set. The resulting F' and I' were converted to true relative photon numbers (F and I), repectively, based on the spectral transmittance of the exciting light-cut filter, effective spectral reflectance of the integrating sphere, spectral sensitivity of the photomultiplier, and the like. An absolute fluorescent quantum yield can then be calculated from F/(I.A.).

The emission quantum yields of water-soluble cyanine dyes, typical light-harvesting dyes of the invention, in a dry gelatin film can thus be obtained by relative measurement based on the standard sample whose absolute emission quantum yield is known.

In view of the intended purpose of getting a wide overlap of an absorption band and an emission band, thereby increasing the energy transmission efficiency, the highly luminescent dye to be used in the present invention preferably has a sufficiently small shift of wavelength between the absorption peak and the emission peak, a so-called Stokes' shift. The Stokes' shift for increasing the energy transmission efficiency is preferably not more than 40 nm, and more preferably not more than 20 nm, at a concentration of $10^{-4}$ mol/dm$^3$ in a dry gelatin film at room temperature. A number of cyanine dyes are found to have a sufficiently small Stokes' shift within 20 nm.

It is favorable that the light-harvesting dye according to the present invention produces an emission band overlapping an absorption band produced by a blue, orthochromatic, or panchromatic sensitizing dye generally employed for black-and-white or color photographic light-sensitive materials and also has a relatively small Stokes' shift as described above. From this point of view, the light-harvesting dye preferably has a maximum absorption wavelength of 400 nm or more, more preferably 420 nm or more, and most preferably from 420 to 740 nm.

From the standpoint of emission quantum efficiency and Stokes' shift, cyanine type dyes are preferred as condensing dyes. According to the report of D. F. O'Brien et al., *Photog. Sci. Eng.*, Vol. 18, p. 76 (1974) on emission yields of various dyes as determined in solutions or other matrices, an oxacarbocyanine derivative was found to have an emission quantum yield of 0.75 in gelatin. In addition to the cyanine dyes, dyes having a skeleton structure of those usable as dye lasers also exemplify the dyes having high emission quantum yields. These condensing dyes are listed, e.g., in Mitsuo Maeda, *Laser Kenkyu*, Vol. 8, pp. 694, 803 and 958 (1980), ibid, Vol. 9, p. 85 (1981), and F. P. Schaefer (ed.), *Dye Lasers*, Springer Verlag (1973). Although many of these dyes are poor in water-solubility as a class, it is possible to render them water soluble and non-adsorbable and thereby employable in the system of the present invention by introducing a plurality of sulfo groups or carboxyl groups into their molecular structure as proposed in the present invention.

The light-harvesting dyes which can be used in the present invention are shown below in classes for illustrative purposes only and should not be construed as limiting upon the scope of the present invention.

I. Water-soluble cyanine or merocyanine dyes
II. Xanthene dyes
III. Acridine dyes
IV. Oxazine dyes
V. Thiazine dyes
VI. Riboflavin dyes
VII. Triarylmethane dyes
VIII. Aminonaphthalene dyes
IX. Pyrene dyes
X. Coumarin dyes
XI. Porphyrin dyes
XII. Phthalocyanine dyes Specific examples of preferred non-adsorbable luminescent dyes to be used in this invention are given below, but the skeleton structure, substituents, and the like shown should not be construed as limiting upon the scope of the present invention.

(I)

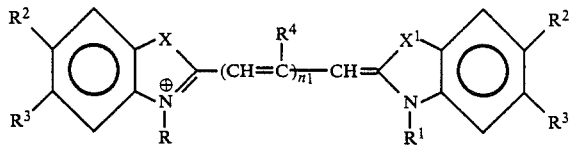

| | X | X¹ | R | R¹ | R² | R³ | R⁴ | $n_1$ |
|---|---|---|---|---|---|---|---|---|
| A-1 | O | O | $(CH_2)_4SO_3^{\ominus}$ | $(CH_2)_4SO_3Na$ | $CO_2Na$ | H | H | 1 |
| A-2 | O | O | " | " | $SO_3Na$ | H | H | 1 |
| A-3 | O | O | " | $(CH_2)_4SO_3K$ | H | $SO_3K$ | — | 0 |
| A-4 | O | O | $(CH_2)_2SO_3^{\ominus}$ | $(CH_2)_2SO_3Na$ | $SO_2(CH_2)_2SO_3Na$ | H | H | 1 |
| A-5 | O | O | " | " | $SO_2NH(CH_2)_2SO_3Na$ | H | H | 1 |
| A-6 | O | O | $(CH_2)_3CO_2^{\ominus}$ | $(CH_2)_3CO_2H$ | $O(CH_2)_3SO_3H$ | $SO_3H$ | $CH_3$ | 1 |
| A-7 | O | O | $(CH_2)_3SO_3^{\ominus}$ | $(CH_2)_3SO_3Na$ | $CONH(CH_2)_2SO_3Na$ | H | H | 1 |
| A-8 | O | O | $(CH_2)_3SO_3^{\ominus}$ | $(CH_2)_3SO_3K$ | $N(CH_2CH_2SO_3K)_2$ | H | H | 1 |
| A-9 | O | 0 | $C_2H_5$ | $C_2H_5$ | $SO_3Na$ | $SO_3Na$ | H | 1 |
| A-10 | O | O | $(CH_2)_3SO_3^{\ominus}$ | $(CH_2)_3SO_3Na$ | $CH_2CO_2Na$ | Cl | H | 1 |
| A-11 | O | O | $(CH_2)_4SO_3^{\ominus}$ | $(CH_2)_4SO_3H$ | $CO_2H$ | H | — | 0 |
| A-12 | O | O | " | " | H | $SO_3H$ | H | 2 |
| A-13 | O | O | " | $(CH_2)_4SO_3K$ | $SO_2(CH_2)_2SO_3K$ | H | H | 3 |
| A-14 | S | S | $(CH_2)_3SO_3^{\ominus}$ | $(CH_2)_3SO_3Na$ | H | $CO_2Na$ | H | 1 |
| A-15 | S | S | " | " | $SO_3Na$ | H | $CH_3$ | 1 |
| A-16 | S | S | $(CH_2)_2SO_3^{\ominus}$ | $(CH_2)_2SO_3Na$ | $SO_2(CH_2)_2SO_3Na$ | Cl | H | 1 |
| A-17 | S | S | " | " | $CONH(CH_2)_2SO_3Na$ | H | H | 1 |
| A-18 | S | S | $(CH_2)_3CO_2^{\ominus}$ | $(CH_2)_3CO_2H$ | $O(CH_2)_3SO_3H$ | H | H | 1 |

-continued

| | | | | | | | | |
|---|---|---|---|---|---|---|---|---|
| A-19 | S | S | $CH_3$ | $CH_3$ | $CH_2SO_3K$ | $SO_3K$ | H | 1 |
| A-20 | S | S | $(CH_2)_4SO_3^{\ominus}$ | $(CH_2)_4SO_3Na$ | H | $CO_2Na$ | — | 0 |
| A-21 | S | S | " | " | $SO_3Na$ | H | — | 0 |
| A-22 | S | S | $(CH_2)_2SO_3^{\ominus}$ | $(CH_2)_2SO_3Na$ | $SO_3Na$ | $SO_3Na$ | H | 2 |
| A-23 | S | S | $(CH_2)_2SO_3^{\ominus}$ | $(CH_2)_2SO_3Na$ | $SO_3Na$ | H | H | 2 |
| A-24 | O | S | $(CH_2)_3SO_3^{\ominus}$ | $(CH_2)_3SO_3H$ | $CO_2H$ | H | — | 0 |
| A-25 | O | S | " | " | $SO_3Na$ | H | H | 1 |
| A-26 | O | S | " | " | $SO_3Na$ | Cl | H | 1 |
| A-27 | O | S | " | $(CH_2)_4SO_3Na$ | H | $O(CH_2)_2SO_3Na$ | H | 1 |
| A-28 | O | S | " | " | H | $SO_3Na$ | H | 2 |
| A-29 | O | S | " | " | $SO_3Na$ | H | $CH_3$ | 2 |

(II)

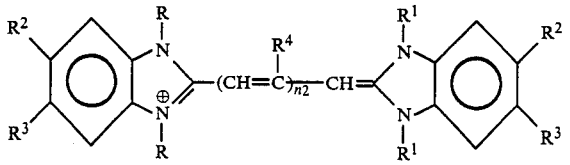

| | R | $R^1$ | $R^2$ | $R^3$ | $R^4$ | $n_2$ |
|---|---|---|---|---|---|---|
| A-30 | $(CH_2)_3SO_3^{\ominus}$ | $CH_2SO_3Na$ | $CF_3$ | H | H | 1 |
| A-31 | " | " | H | Cl | H | 1 |
| A-32 | " | " | $(CH_2)_4SO_3Na$ | H | H | 1 |
| A-33 | " | $CH_2CO_2K$ | $(CH_2)_4SO_3K$ | $(CH_2)_4SO_3K$ | $CH_3$ | 1 |
| A-34 | " | $(CH_2)_3SO_3K$ | $CF_3$ | H | H | 1 |
| A-35 | " | " | $CO_2K$ | Cl | H | 2 |
| A-36 | " | $CH_2CO_2K$ | H | Cl | H | 2 |
| A-37 | " | $CH_2SO_3H$ | $(CH_2)_4SO_3H$ | H | H | 3 |

(III)

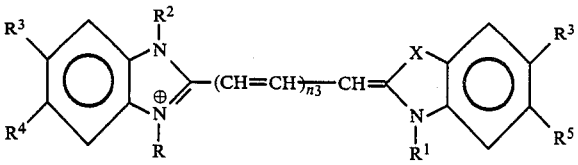

| | X | R | $R^1$ | $R^2$ | $R^3$ | $R^4$ | $R^5$ | $n_3$ |
|---|---|---|---|---|---|---|---|---|
| A-38 | S | $(CH_2)_4SO_3^{\ominus}$ | $(CH_2)_4SO_3K$ | $CH_2CO_2K$ | H | $CF_3$ | $CO_2K$ | 1 |
| A-39 | S | " | " | $(CH_2)_4SO_3K$ | $CO_2K$ | H | $CO_2K$ | 1 |
| A-40 | S | " | " | " | H | $(CH_2)_4SO_3K$ | $O(CH_2)_2SO_3K$ | 1 |
| A-41 | S | " | $C_2H_5$ | " | H | $CH_2CO_2K$ | $CH_2CO_2K$ | 1 |
| A-42 | S | $(CH_2)_3SO_3^{\ominus}$ | $(CH_2)_3SO_3Na$ | $CH_2CO_2Na$ | H | $CF_2$ | $SO_3Na$ | 2 |
| A-43 | S | " | " | " | H | Cl | " | 0 |
| A-44 | O | " | " | $CH_2CO_2Na$ | H | Cl | $CO_2Na$ | 1 |
| A-45 | O | $(CH_2)_2SO_3^{\ominus}$ | $(CH_2)_2SO_3Na$ | $CH_2SO_3Na$ | H | Cl | " | 2 |
| A-46 | O | " | " | " | H | Cl | " | 3 |

(IV)

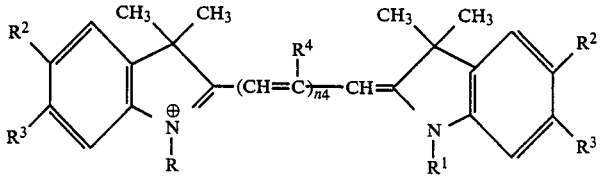

| | R | $R^1$ | $R^2$ | $R^3$ | $R^4$ | $n_4$ |
|---|---|---|---|---|---|---|
| A-47 | $(CH_2)_4SO_3^{\ominus}$ | $(CH_2)_4SO_3K$ | $SO_3K$ | H | H | 1 |
| A-48 | " | $(CH_2)_4SO_3H$ | $SO_3H$ | H | H | 1 |
| A-49 | " | " | $CH_2CO_2K$ | Cl | H | 1 |
| A-50 | $(CH_2)_2O(CH_2)_3SO_3^{\ominus}$ | $(CH_2)_2O(CH_2)_3SO_3K$ | $SO_3K$ | H | H | 1 |
| A-51 | $(CH_2)_3SO_3^{\ominus}$ | $(CH_2)_3SO_3Na$ | $(CH_2)_2CO_2Na$ | H | H | 1 |
| A-52 | " | " | $SO_3Na$ | H | Cl | 1 |
| A-53 | $(CH_2)_3SO_3^{\ominus}$ | $(CH_2)_3SO_3Na$ | $CH_2CO_2Na$ | H | — | 0 |
| A-54 | $(CH_2)_2CO_2^{\ominus}$ | $(CH_2)_2CO_2Na$ | $SO_3Na$ | H | — | 0 |
| A-55 | $C_2H_5$ | $C_2H_5$ | $SO_3Na$ | $SO_3Na$ | H | 2 |
| A-56 | $(CH_2)_3SO_3^{\ominus}$ | $(CH_2)_3SO_3Na$ | $CO_2Na$ | H | H | 2 |

-continued (V)

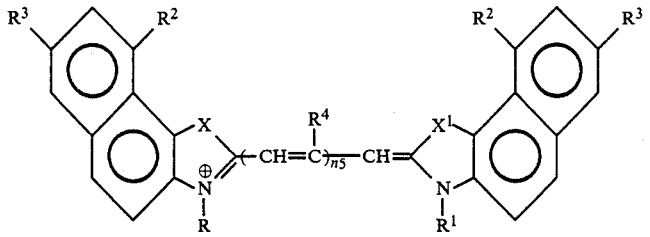

| | X | X¹ | R | R¹ | R² | R³ | R⁴ | n5 |
|---|---|---|---|---|---|---|---|---|
| A-57 | O | O | $(CH_2)_3SO_3^{\ominus}$ | $(CH_2)_3SO_3Na$ | $SO_3Na$ | $SO_3Na$ | — | 0 |
| A-58 | O | O | " | " | " | " | $CH_3$ | 1 |
| A-59 | O | O | " | " | $CO_2Na$ | $CO_2Na$ | H | 2 |
| A-60 | S | S | $C_2H_5$ | $C_2H_5$ | $SO_3Na$ | $SO_3Na$ | H | 1 |
| A-61 | S | S | $CH_2CO_2^{\ominus}$ | $CH_2CO_2K$ | " | " | — | 0 |
| A-62 | O | S | $(CH_2)_4SO_3^{\ominus}$ | $(CH_2)_4SO_3K$ | " | " | H | 1 |
| A-63 | O | S | " | " | " | " | H | 2 |
| A-64 | $NCH_3$ | $NCH_3$ | " | " | " | " | H | 1 |
| A-65 | $NCH_3$ | S | " | " | " | " | H | 1 |
| A-66 | $NCH_3$ | O | " | " | " | " | H | 1 |

(VI)

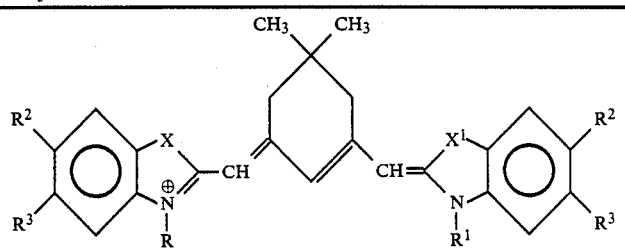

| | X | X¹ | R | R¹ | R² | R³ |
|---|---|---|---|---|---|---|
| A-67 | S | S | $(CH_2)_3SO_3^{\ominus}$ | $(CH_2)_3SO_3Na$ | $SO_3Na$ | H |
| A-68 | S | S | " | $(CH_2)_3SO_3K$ | $CO_2K$ | H |
| A-69 | S | O | " | " | H | $SO_3K$ |
| A-70 | S | O | " | " | $OCH_2SO_3K$ | H |

A-71

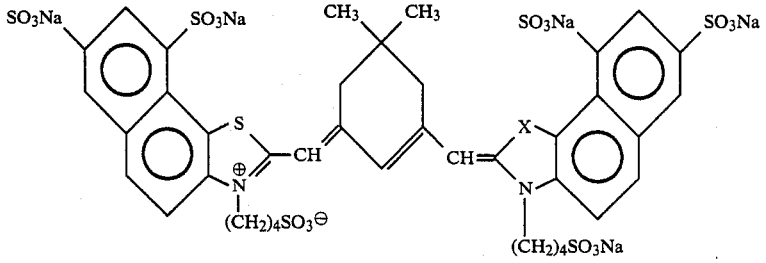

X = S, O

A-72

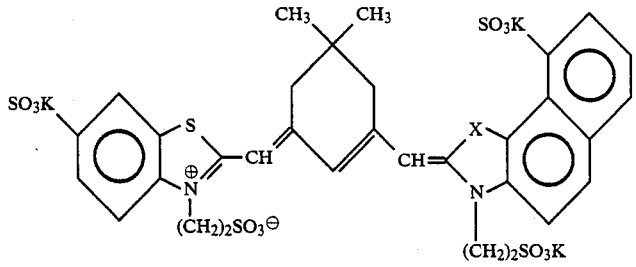

X = S, O

A-73

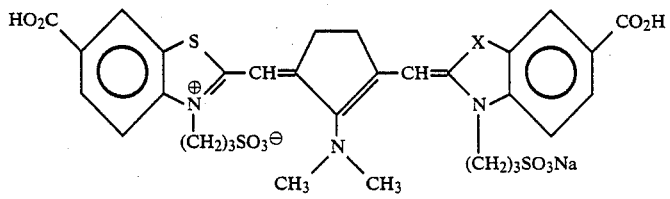

-continued

X = S, O

A-74

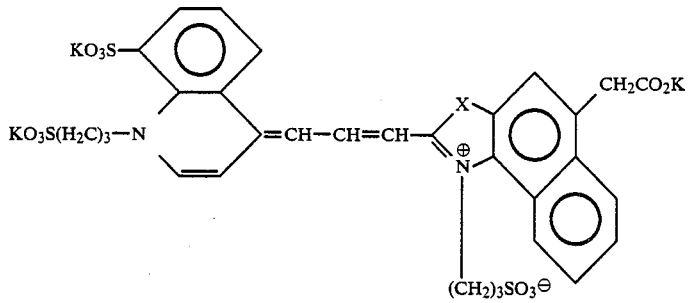

X = S, O

A-75

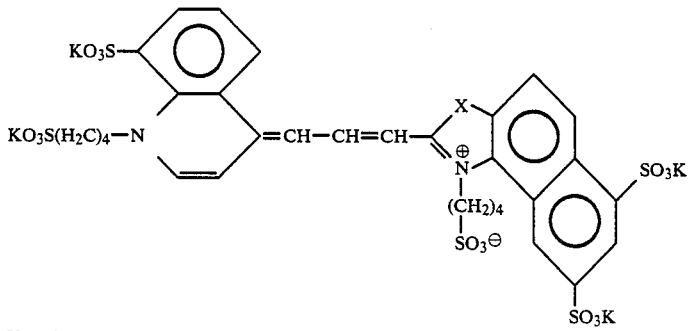

X = S, O

A-76

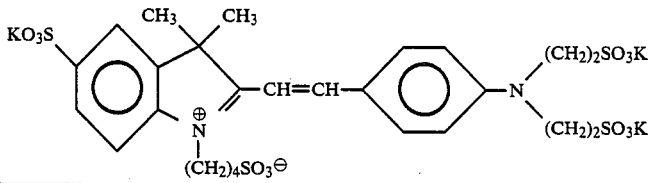

Any of the above-illustrated light-harvesting dyes (A-1 to A-76) has an adsorption to silver bromide of no more than $5\times10^{-7}$ as determined under the conditions specified in the present invention and an emission quantum yield of no less than 0.1 as determined under the conditions as specified in the present invention. In particular, Dyes A-1 to 11 and Dyes A-47 to 54 have high emission quantum yields of 0.7 or more.

The above-described cyanine dyes can be synthesized by known processes, for example, various processes described in F. M. Hamer, *The Cyanine Dyes and Related Compounds,* Interscience, New York (1964). Typical synthesis examples are set forth below.

SYNTHESIS EXAMPLE 1

Synthesis of Dye A-1

In a 100 ml-volume flask equipped with a stirrer were placed 6.3 g of 4-(6-carboxy-2-methylbenzoxazolio-3)butanesulfonate, 12 g of ethyl orthoformate, 18 ml of pyridine, and 7 ml of acetic acid, and the mixture was heated while stirring for 1.5 hours in an oil bath previously heated to 140° C. After allowing the mixture to cool, the precipitated crystals were collected by filtration, washed successively with acetone and methanol, and dissolved in methanol containing triethylamine. Any insoluble matter was removed by filtration, and a methanolic solution of sodium iodide was added to the filtrate. The precipitated crystals were separated by filtration, washed with methanol while hot, and dried under reduced pressure to obtain 4.11 g (58.5%) of Dye A-1 having a melting point of 300° C. or higher.

$\lambda_{max}^{MeOH}=496$ nm($\epsilon=1.32\times10^5$).

SYNTHESIS EXAMPLE 2

Synthesis of Dye A-47

In a 1 l-volume flask equipped with a stirrer were charged 69 g of 4-(2,3,3-trimethyl-5-sulfo-3H-indolio-3)butanesulfonate, 55 ml of ethyl orthoformate, 69 ml of acetic acid, and 150 ml of pyridine, and the mixture was heated with stirring for 1 hour in an oil bath heated to 140° C. After allowing the mixture to cool to room temperature, 400 ml of acetone was added thereto, followed by decantation to remove the supernatant liquor. The residual solid was dissolved in 500 ml of methanol, and a methanolic solution of potassium acetate was added thereto, followed by heat-refluxing for 10 minutes. The precipitated crystals were collected by filtration and washed with isopropanol. The solid was reprecipitated using water and isopropanol, and the resulting crystals were dried to obtain 41.2 g (52.3%) of Dye A-47 having a melting point of 300° C. or higher.

$\lambda_{max}^{MeOH}=555$ nm ($\epsilon1.33\times10^5$).

In the silver halide photographic materials of the present invention, the light-sensitive silver halide forms a fine dispersion in a medium, and the individual silver halide grains have an adsorbed layer of a spectral sensitizing dye on their surface and are spectrally sensitized thereby. Outside of the adsorbed layer of the sensitizing dye, there is a hydrophilic colloidal medium having uniformly dispersed therein water-soluble light-harvesting dye molecules, composing a light-sensitive element in cooperation with the light-sensitive silver halide. The light-harvesting dye particles dispersed in the hydrophilic colloidal medium exist with the chromophoric groups thereof being not adsorbed directly on the light-sensitive silver halide grains.

The light-harvesting dye is preferably incorporated in a silver halide emulsion layer containing an adsorbable sensitizing dye.

The light-harvesting dye is preferably added to a dispersion medium in a concentration not less than $2\times10^{-3}$ mol/dm$^3$, and more preferably not less than $10^{-2}$ mol/dm$^3$. The term "concentration" as used herein means a concentration based on a dry volume of a dispersion medium excluding the silver halide grain surface and the sensitizing dye adsorbed on the grain surface. The upper limit of the concentration is preferably $10^{-1}$ mol/dm$^3$ considering that too a high concentration sometimes causes saturation or reduction of sensitization efficiency.

The light-harvesting dyes may be used either individually or in combintions of two or more thereof provided that at least a part of the emission wavelength band of these dyes should overlap the optical absorption band of at least one sensitizing dye to be adsorbed onto the silver halide grains. For substantial satisfaction of this condition, it is desirable that the light-harvesting dye which gives its maximal emission at a longer wavelength, than that of any other light-harvesting dyes exhibits its highest emission wavelength in the vicinity of the maximum absorption wavelength of the sensitizing dye which gives its maximal absorption at a longer wavelength than that of any other sensitizing dyes to which the energy is transmitted, and more preferably within a range of from the maximum, absorption wavelength to a wavelength shorter by 60 nm, and particularly by 30 nm. Further, in favor of Förster type energy transfer, it is preferable that the light-harvesting dye itself shows an absorption band and an emission band in the medium overlapping with each other and that the difference between the maximum absorption wavelength and the maximum emission wavelength, i.e., the Stokes' shift, is within 40 nm, and more preferably within 20 nm, in the medium.

If necessary, the light-harvesting dye according to this invention may be used in combination with an appropriate surface active agent or any other organic additive as a solubilizer or association inhibitor.

The light-harvesting dye present in a hydrophilic colloidal layer may be mordanted with an appropriate cationic polymer, etc. Examples of the cationic polymers suitable for this purpose are described, e.g., in British Pat. No. 685,475, U.S. Pat. Nos. 2,675,316, 2,839,401, 2,882,156, 3,048,487, 3,184,309 and 3,445,231, West German OLS No. 1,914,362, and Japanese Patent Application (OPI) Nos. 47624/75 and 71332/75.

The light-harvesting dye to be used in the invention should be rapidly driven out of the light-sensitive material by development processing or washing with water or be decomposed and bleached during processing. It is preferable to use such a light-harvesting dye that can be decolorized by, for example, hydrolysis in an alkaline processing solution after having been removed from the light-sensitive material.

The light-harvesting dye preferably has a reduced potential of less than $-1.0$ V with reference to a saturated calomel electrode in a water/ethanol (1:1 by volume) solution. The reduced potential of dyes can be measured in accordance with the method described in Tadaaki Tani et al., Denkikagaku, Vol. 34, p. 149 (1966).

The hydrophilic dispersion medium which can be used in the emulsion layers or intermediate layers includes gelatin to advantage. Other hydrophilic colloids may also be used, including proteins, such as gelatin derivatives, graft polymers of gelatin and other high polymers, albumin, casein, etc.; cellulose derivatives, e.g., hydroxyethyl cellulose, carboxymethyl cellulose, cellulose sulfate, etc.; sugar derivatives, e.g., sodium alginate, starch derivatives, etc.; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinyl pyrazole, etc., and copolymers comprising monomers constituting these homopolymers. The gelatin to be used includes not only lime-processed gelatin for general purposes, but also acid-processed gelatin, enzyme-processed gelatin as described in *Bull. Soc. Sci. Photo. Japan,* No. 16, p. 30 (1966), and hydrolysis products of gelatin.

The halogen composition of light-sensitive silver halide is conventional and includes, for example, silver iodobromide, silver chloride, silver chlorobromide, silver chloroiodobromide, etc. The light-sensitive silver halide grains may have any crystal form, such as spherical, tabular, octahedral, cubic, tetradecahedral, and amorphous forms. Inter alia, tabular grains are preferred because of their large area for dye adsorption in favor of high spectral sensitization. The tabular grains preferably comprise those having an aspect ratio (diameter/thickness ratio) of at least 5, and particularly at least 8, in a ratio of 50% or more based on the total projected area. Examples of preferred tabular grains are described, for example, in *Research Disclosure,* No. 22534, Vol. 225 (January, 1983), Japanese Patent Application (OPI) Nos. 127921/83 and 99433/84, and U.S. Pat. No. 4,585,729.

The individual silver halide grains may be either homogeneous or heterogeneous in halogen composition. Heterogeneous grains preferably include those having a double-layered structure in which the core and the outer shell have different compositions. In addition, epitaxially grown grains in which fine crystals having different halogen compositions are fused together as described in U.S. Pat. Nos. 4,094,684, 4,459,343 and 4,463,087, and Japanese Patent Application (OPI) No. 108526/83; grains having incorporated therein a spectral sensitizing dye as described in *Photo. Sci. Eng.,* Vol. 8, p. 102 (1968); grains having a high-order index of a plane as described in Japanese Patent Application (OPI) No 123446/87; grains of troglodyte nuclei type; and the like can also be employed preferably.

The mean grain size of the silver halide grains is not particularly limited and is preferably not greater than 3 m, and more preferably not greater than 1.8 μm, as a diameter of a corresponding sphere. Grain size distribution may be either narrow or broad.

The individual silver halide grains may have a homogeneous phase or a heterogeneous phase between the inside and the surface. They may be of a surface latent image type which forms a latent image predominantly on their surface or of an inner latent image type which forms a latent image predominantly in the inside thereof. The former type of grains are preferred.

In the process of silver halide grain formation or physical ripening, a cadmium salt, a zinc salt, a lead salt, a thallium salt, an iridium salt or a complex salt thereof, a rhodium salt or a complex salt thereof, an iron salt or a complex salt thereof, etc. may be present in the system.

Silver halide emulsions to be used may be primitive but is usually subjected to chemical sensitization in a well-known manner. Chemical sensitization techniques are described, e.g., in H. Frieser (ed.), *Die Grundlagen der Photographischen Prozesse mit Silber-halogeniden,* pp. 675–734, Akademische Verlagsgellschaft (1968).

In some detail, chemical sensitization can be carried out by sulfur sensitization using active gelatin or a sulfur-containing compound capable of reacting with silver (e.g., thiosulfates, thioureas, mercapto compounds, rhodamines, etc.), reduction sensitization using a reducing substance (e.g., stannous salts, amines, hydrazine derivatives, formamidine-sulfinic acid, silane compounds, etc.), noble metal sensitization using a noble metal compound (e.g., gold complex salts and complex salts of other noble metals of Group VIII), or a combination thereof. In the present invention, sulfur sensitization or a combination of sulfur sensitization and gold sensitization is particularly preferred.

For the purpose of preventing fog during preparation, preservation or photographic processing of light-sensitive materials or stabilizing photographic performance, a variety of compounds may be incorporated into silver halide emulsions. Such compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5mercaptotetrazole), etc.; mercaptopyrimidines; mercaptotriazines; thioketo compounds, e.g., oxazolinethion, etc.; azaindenes, e.g., triazaindenes, tetraazaindenes (especially 4-hydroxy-substituted (1,3,3a,7)tetraazaindenes), pentaazaindenes, etc.; benzenethiosulfonic acids, benzenesulfinic acids, benzenesulfonic acid amines; and other various compounds known as antifoggants or stabilizers.

For the purpose of increasing sensitivity or contrast or accelerating development, the photographic emulsions may further contain, for example, polyalkylene oxide or derivatives thereof, e.g., ethers, esters and amines, thioether compounds, thiomorpholine compounds, quaternary ammonium salt compounds, urethane derivatives, urea derivatives, imidazole derivatives, 3-pyrazolidone compounds, and the like.

At least one kind of the light-sensitive silver halide used in the present invention is subjected to spectral sensitization with an adsorbable spectral sensitizing dye. In this case, it is desirable that the surface coverage of the adsorbable dye is at least 20%, and more preferably at least 40%, of a saturated adsorption in a monomolecular layer. Light-sensitive materials using a sensitizing dye for spectral sensitization include negative light-sensitive materials of the general surface latent image type and direct positive light-sensitive materials of the inner latent image type.

The positive light-sensitive materials include, for example, those in which an electron accepting dye is used and a positive image is formed by destruction of surface fog centers upon exposure to light.

Depending on the use of the light-sensitive materials, the adsorbable dye may be used in combination with adsorbable supersensitizers or various additives (e.g., antifoggants) for the purpose of attaining the optimum degree of spectral sensitization.

The adsorbable dye for spectral sensitization includes cyanine dyes, merocyanine dyes, complex cyanine dyes, complex merocyanine dyes, holopolar cyanine dyes, hemicyanine dyes, styryl dyes, hemioxonol dyes, xanthene dyes, triarylmethane dyes, phenothiadine dyes, acridine dyes, metal chelate compounds, and the like. Of these, cyanine dyes, merocyanine dyes, and complex merocyanine dyes are particularly useful.

To these dyes is applied any of basic heterocyclic nuclei usually utilized in cyanine dyes, such as pyrroline, oxazoline, thiazoline, pyrrole, oxazole, thiazole, selenazole, imidazole, tetrazole, and pyridine nuclei; the above-enumerated nuclei to which an alicyclic hydrocarbon ring is fused; and the above-recited nuclei to which an aromatic hydrocarbon ring is fused, e.g., indolenine, benzindolenine, indole, benzoxazole, naphthothiazole, benzoselenazole, benzimidazole, and quinoline nuclei. These nuclei may have a substituent on the carbon atom.

Preferred among these cyanine dyes are those exhibiting especially high sensitizing efficiency when used alone or in combination with a supersensitizer. Such cyanine dyes include those having at least one of thiazole, selenazole, quinoline, and indolenine nuclei and those having at least two oxazole nuclei or at least two imidazole nuclei. It goes without saying that these basic heterocyclic nuclei in the preferred cyanine dyes may have an alicyclic hydrocarbon ring and/or an aromatic hydrocarbon ring fused thereto.

To merocyanine dyes or complex merocyanine dyes is applicable a 5- or 6-membered heterocyclic nucleus having a ketomethylene structure, such as pyrazolin-5-one, thiohydantoin, 2-thiooxazolidine-2,4-dione, thiazolidine-2,4-dione, rhodanine, and thiobarbituric acid nuclei, etc. Specific examples of useful sensitizing dyes are described, e.g., in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, and Japanese Patent Publication Nos. 14030/69 and 24844/77.

These sensitizing dyes may be used either individually or in combinations thereof. In particular, combinations of sensitizing dyes are frequently employed for the purpose of supersensitization. Typical examples of such dye combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The photographic emulsions may contain, in addition to the sensitizing dye, a dye having no spectral sensitizing activity by itself or a substance that does not absorb a substantial amount of visible light, while exhibiting supersensitizing activity. Examples of such a dye or substance include aminostilbene compounds substituted with a nitrogencontaining heterocyclic group (e.g., the compounds described in U.S. Patents 2,933,390 and 3,635,721), aromatic organic acid-formaldehyde condensates (e.g., the compound described U.S. Pat. No. 3,743,510), cadmium salts, and azaindene compounds. The combinations described in U.S. Pat. Nos. 3,615,613, 3,615,641, 3,617,295 and 3,653,721 are particularly useful.

In the case where the present invention is applied to color light-sensitive materials, various color couplers capable of forming a dye upon coupling with an oxidation product of an aromatic primary amine developing agent can be employed. Typical examples of useful color couplers are cyan couplers, e.g., naphthol compounds and phenol compounds; magenta couplers, e.g., pyrazolone compounds and pyrazoloazole compounds; and yellow couplers, e.g., openchain or heterocyclic ketomethylene compounds. Specific examples of these cyan, magenta, and yellow couplers are described in patents cited in *Research Disclosure,* 17643, VII-D (December, 1978) and ibid, 18717 (November, 1979).

In order to satisfy the characteristics required for the light-sensitive materials, two or more kinds of these couplers may be incorporated into one layer, or one kind of these couplers may be incorporated into two or more layers.

Color negative light-sensitive materials for photographing preferably contain colored couplers for correction of unnecessary absorption in the shorter wavelength region exhibited by the dye produced from magenta or cyan couplers. Typical examples of the colored couplers include yellow-colored colored magenta couplers as described, e.g., in U.S. Pat. No. 4,163,670 and Japanese Patent Publication No. 39413/82 and magenta-colored cyan couplers as described, e.g., in U.S. Pat. Nos. 4,004,929 and 4,138,258, and British Pat. No. 1,146,368.

Couplers which produce a dye having moderate diffusibility can be used to improve graininess. Specific examples of such blurring couplers are described in U.S. Pat. No. 4,366,237 and British Pat. No. 2,125,570 for magenta couplers; and European Pat. No. 96,570 and West German OLS No. 3,234,533 for yellow, magenta or cyan couplers.

The dye forming couplers and the above-described special couplers may be in the form of a polymer, including a dimer. Typical examples of polymerized dye forming couplers are described in U.S. Pat. Nos. 3,451,820 and 4,080,211. Specific examples of polymerized magenta couplers are described in British Pat. No. 2,102,173, U.S. Pat. No. 4,367,282, and Japanese Patent Application (OPI) Nos. 75041/85 and 113596/85.

Couplers capable of releasing a photographically useful residue upon coupling are also used preferably. Useful DIR couplers capable of releasing a developing inhibitor are described in the patents cited in *Research Disclosure,* 17643, VII-F (December, 1978).

In addition, the light-sensitive materials can contain couplers capable of imagewise releasing a nucleating agent or a development accelerator or a precursor thereof. Specific examples of such couplers are described in British Pat. Nos. 2,097,140 and 2,131,188. In particular, couplers releasing a nucleating agent, etc. which is adsorbable onto silver halide grains, such as those described in Japanese Patent Application (OPI) Nos. 157638/84 and 170840/84, are preferred.

Any hydrophilic colloidal layer constituting the photographic emulsion layers or backing layer may contain an organic or inorganic hardening agent. The hardening agent to be added includes chromium salts, aldehydes (e.g., formaldehyde, glyoxal, glutaraldehyde, etc.), N-methylol compounds (e.g., dimethylolurea, etc.), and the like. Active halogen compounds (e.g., 2,4-dichloro-6-hydroxy-1,3,5-triazine, etc.) and active vinyl compounds (e.g., 1,3-bisvinyl- sulfonyl-2-propanol, 1,2-bis-vinylsulfonylacetamidoethane, vinyl polymers having a vinylsulfonyl group in the side chain thereof, etc.) are preferred hardening agents as they rapidly harden a hydrophilic colloid, such as gelatin, to provide stable photographic characteristics. N-carbamoylpyridinium salts and haloamidinium salts are also excellent in rate of hardening.

In addition, the silver halide emulsion to be used in this invention may contain various other additives, such as surface active agents, thickeners, dyes, ultraviolet absorbents, antistatics, brightening agents, desensitizers, developing agents, discoloration inhibitors, mordants, and the like. Specfic examples of these additives are described, e.g., in *Research Disclosure,* 17643, Vol. 176, pp. 22–31 (December, 1978) and T. H. James (ed.), *The Theory of the Photographic Process* (4th Ed.), Macmillan Publishing Co., Inc. (1977).

The photographic emulsion layers and other layers are coated on a support usually employed for photographic light-sensitive materials, including flexible supports, such as plastic films, paper, cloth, etc.; and rigid supports, such as glass, ceramics, metals, etc. Useful as flexible supports are films made of synthetic or semi-synthetic high polymers, e.g., cellulose nitrate, cellulose acetate, cellulose acetate butyrate, polystyrene, polyvinyl chloride, polyethylene terephthalate, polycarbonate, etc.; and paper coated or laminated with a baryta layer or an α-olefin polymer (e.g., polyethylene, polypropylene, an ethylene/butene copolymer, etc.).

These supports may be colored with dyes or pigments. They may be colored in black for the purpose of light shielding.

The surface of the support is generally subjected to subbing treatment to improve adhesion to the photographic emulsion layers, etc. Before or after the subbing treatment, the support surface may be subjected to glow discharge treatment, corona discharge treatment, ultraviolet irradiation, flame treatment or the like surface treatment.

Exposure to light for forming a photographic image can be carried out in an usual manner using any known light source, such as natural light (sunlight), a tungsten lamp, a fluorescent lamp, a mercury lamp, a xenon arc lamp, a carbon arc lamp, a xenon flash lamp, a cathode ray tube (CRT), a flying spot, etc. The exposure time usually ranges from 1/1000 second generally used in photographing with cameras to 1 second. Exposure may also be effected for a time shorter than 1/1000 second, e.g., from $1/10^4$ to $1/10^9$ second, with a xenon flash lamp, a CRT, or a laser beam; or for a time longer than 1 second. If desired, a color filter can be used for exposure to control the spectral composition of the incident light. Further, exposure may be carried out using light emitted from a fluorescent substance excited by electron rays, X-rays, λ-rays, α-rays, etc.

Photographic processing of the light-sensitive materials according to the present invention can be carried out by any of known methods and known processing solutions whether for black-and-white photographic processing for forming a silver image or for color photographic processing for forming a dye image, for example, the methods and processing solutions described in *Research Disclosure,* 17643, Vol. 176, pp. 28–30 (December, 1978). The processing temperature is usually selected from the range between 18° C. and 50° C. Temperature lower than 18° C. or higher than 50° C. are also employable.

In a special mode of development processing, that is also applicable to the light-sensitive materials of the present invention, a developing agent may be incorporated into the light-sensitive material, e.g., an emulsion layer, and the light-sensitive material is processed in an alkaline aqueous solution to carry out development. In this case, a hydrophobic developing agent can be introduced into an emulsion layer according to various methods as described, e.g., in *Research Disclosure,* 16928, Vol. 169 (May, 1978), U.S. Pat. No. 2,739,890, British Pat. No. 813,253, and West German Pat. No. 1,547,763. Such development processing may be combined with silver salt stabilization processing using thiocyanates.

A fixer to be used may have a commonly employed composition. A fixing agent includes not only thiosulfates and thiocyanates, but also organic sulfur compounds known to exhibit fixing effects. The fixer may contain a water-soluble aluminum salt as a hardening agent.

A color developer generally comprises an alkaline aqueous solution containing a color developing agent. The color developing agent includes known aromatic primary amine developing agents, such as phenylenediamines (e.g., 4-amino-N,N-diethylaniline, 3-methyl-4-amino-N,N-diethylaniline, 4-amine-N-ethyl-N-β-hydroxyethylaniline, 3-methyl-4-amino-N-ethyl-N-β-hydroxyethylaniline, 3-methyl-4amino-N-ethyl-N-β-methanesulfonamidoethylaniline, 4-amino-3-methyl-N-ethyl-N-β-methoxyethylaniline, etc.).

In addition, the color developing agents disclosed in L. F. A. Mason, *Photographic Processing Chemistry,* 226–229, Focal Press 81966), U.S. Pat. Nos. 2,193,015 and 2,592,364, and Japanese Patent Application (OPI) No. 64933/73 are also useful.

The color developer may contain one or more pH buffering agents, development restrainers, antifoggants, etc. If desired, it may further contain one or more water softeners, preservatives, organic solvents, development accelerators, dye forming couplers, competing couplers, fogging agents, auxiliary developing agents, viscosityimparting agents, polycarboxylic acid type chelating agents, antioxidants, and the like. Specific examples of these additives are described, e.g., in *Research Disclosure,* 17643 (December, 1978), U.S. Pat. No. 4,083,723, and West German OLS No. 2,622,950.

The photographic emulsion layers after color development are generally subjected to bleaching. Bleaching may be effected simultaneously with fixation, or these two steps may be performed separately. A bleaching agent to be used includes compounds of polyvalent metals [e.g., iron (III), cobalt (III), chromium (VI), copper (II), etc.], peracids, quinones, nitroso compounds, and so on. Examples of these bleaching agents are ferricyanides; bichromates; organic complex salts of iron (III) or cobalt (III), such as complex salts with an aminopolycarboxylic acid (e.g., ethylenediaminettraacetic acid, nitrilotriacetic acid, 1,3-diamino-2propanolacetic acid, etc.) or an organic acid (e.g., citric acid, tartaric acid, malic acid, etc.); persulfates; permanganates; nitrosophenol; and the like. Of these, potassium ferricyanide, sodium (ethylenediaminetetraacetato)iron (III), and ammonium (ethylenediaminetetraacetato)iron (III) are particularly useful. Ethylenediaminetetraacetato iron (III) salts are useful in both an independent bleaching bath and a combined blix bath.

The bleach or blix bath can contain various additives, such as a bleach accelerator as described in U.S. Patents 3,042,520 and 3,241,966, and Japanese Patent Publication Nos. 8506/70 and 8836/70; a thiol compound as described in Japanese Patent Application (OPI) No. 65732/78; and the like.

In carrying out photographic processing of the light-sensitive materials according to the present invention, an additive capable of reacting with the light-harvesting dye present in the light-sensitive material to thereby decompose the light-harvesting dye may be incorporated into any processing solution for development, blix, etc.

The present invention can be applied to a variety of light-sensitive materials for both color and black-and-white photography, typically embracing color negative films for general use or for movies, color reversal films for slides or TV, color papers, color positive films, color reversal films, color light-sensitive materials for a diffusion transfer process, and heat developable color light-sensitive materials. The present invention is also applicable to black-and-white photographic materials including X-ray films by utilizing mixing of three color couplers as disclosed in *Research Disclosure,* 17123, Vol. 171 (July, 1978) or black-forming couplers as disclosed in U.S. Pat. No. 4,126,461 and British Patent No. 2,102,136. The present invention is also applicable to plate making films, such as lith films and scanner films, direct or indirect X-ray films for medical use or for industry, black-and-white negative films for photographing, black-and-white photographic papers, microfilms for COM or general use, photographic materials for a silver salt diffusion transfer process, and print-out type photographic materials.

In the application of the present invention to silver halide light-sensitive materials containing an emulsion layer which has been spectrally sensitized with a sensitizing dye, the advantage produced lies in improvement of their spectral sensitivity by a combined use of a light-harvesting dye. In a particularly preferred application of the present invention, it is intended that the relatively low sensitivity to a wavelength region corresponding to a valley between an inherent sensitivity and a spectral sensitivity, e.g., sensitivity to a blue region (from 450 to 520 nm), in the case of black-and-white light-sensitive materials, may be improved or the spectral sensitivity to a blue, green, or red region may be enhanced in the case of color light-sensitive materials, by the addition of a light-harvesting dye.

Since the light-harvesting dye in a dispersion medium serves as a sensitizer and, at the same time, as an absorber by itself, the technique according to the present invention is not only effective to improve sensitivity through spectral sensitization, but also improve image sharpness by taking advantage of the anti-irradiation effect or anti-halation effect of the light-harvesting dye. In general, use of anti-irradiation dyes or anti-halation dyes is attended by desensitization due to filter effects. To the contrary, the present invention makes it possible to improve sharpness while increasing sensitivity without causing a substantial reduction of sensitivity.

Taking, for instance, direct X-ray films for medical use having an emulsion layer on both sides of a support, it is known that fluorescence emitted from a fluorescent intensifying screen and transmitted to a light-sensitive layer on the side opposite to the incident side, i.e., so-called cross-over light, seriously impairs image sharpness. By applying the present invention to this photographic medium, the absorption on the incident side is greatly increased so that sensitivity is increased and, at the same time, the above-described cross-over light is blocked to thereby ring about marked improvement in sharpness.

The present invention is illustrated in greater detail by way of the following examples, but it should be understood that the present invention is not deemed to be limited to these examples. Unless otherwise indicated herein, all parts, percents, ratios and the like are by weight.

EXAMPLE 1

An octahedral grain silver bromide emulsion (silver content: $7\times10^{-4}$ mol/g; mean grain size: 0.8 μm) was prepared in the presence of ammonia according to a double jet method. The emulsion was chemically sensitized in the presence of chloroauric acid and sodium thiosulfate. A sensitizing dye having the formula shown below (S-1) was added thereto in such an amount as to be adsorbed onto the surface of emulsion grains to 50% of a saturated adsorption in a monomolecular layer. Then, 4-hydroxy-6-methyl-1,3,3a,7-tetrazaindene was added thereto as a stabilizer in an amount of 10 mols per mol of the sensitizing dye.

To the thus prepared green-sensitive highly sensitive silver halide emulsion was added a 0.005M aqueous solution of a water-soluble light-harvesting dye according to the present invention (A-1) in an amount up to 10 ml per 60 g of. the emulsion. After uniformly mixing, sodium p-dodecylbenzenesulfonate was added as a coating aid in an amount of 4 mg per gram of gelatin.

The resulting coating composition was uniformly coated on a transparent support made of polyethylene terephthalate to a silver coverage of 2.5 g/m$^2$ and a gelatin coverage of 4.0 g/m$^2$, and dried. The resulting samples were designated as I-3 to I-6.

For comparison, Sample I-1 was prepared in the same manner as Samples I-3 to I-6, except that the sensitizing dye (S-1) was not used, and Sample I-2 was prepared in the same manner as Samples I-3 to I-6, except that no light-harvesting dye was added.

The light-harvesting dye (A-1) had an emission yield of about 0.9 in a dry gelatin film at a concentration of $10^4$ mol/dm$^2$, a maximum absorption wavelength of 504 nm, and a maximum emission wavelength of from 520 to 550 nm (shifting to a longer wavelength with increasing concentration). The sensitizing dye (S-1) had a maximum absorption wavelength of 600 nm.

The sensitizing dye (S-1) has the following structural formula.

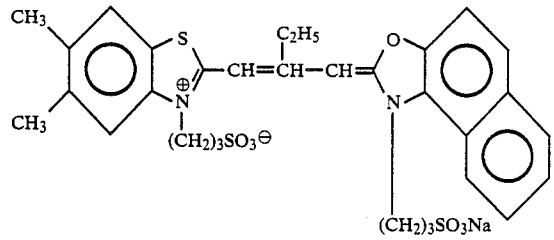

Each of Sample I-1 to I-6 was wedgewise exposed to white light emitted from a 1 kW tungsten lamp (color temperature: 2854° K.) for 1/100 second; or exposed to monochromatic light for 1/20 second through an interference filter transmitting light having a wavelength of 500 nm or 600 nm (near the absorption peak of the sensitizing dye) at which the light-harvesting dye (A-1) or sensitizing dye (S-1) is concerned chiefly with light absorption, respectively.

The thus exposed sample was developed with a developer having the following formulation at 20° C. for 10 minutes.

| Developer Formulation | |
|---|---|
| Metol | 2.5 g |
| L-Ascorbic acid | 10.0 g |
| Nabox | 35.0 g |
| Potassium bromide | 1.0 g |
| water to make | 1000 ml |

The photographic performance of the resulting negative image are shown in Table 1 below. In Table 1, the sensitivity means a reciprocal of an expoure which provides a density of fog +0.2 and is relatively expressed taking the value of Sample I-2 containing no light-harvesting dye as a standard (100).

TABLE 1

| Sample No. | Sensitizing Dye | Light-Harvesting Dye | Light-Harvesting Dye Concn. in Gelatin (mmol/dm$^3$) | Relative Sensitivity White Light | 600 nm | 500 nm | $D_{max}$ of Developed Silver | Remark |
|---|---|---|---|---|---|---|---|---|
| I-1 | none | A-1 | 10.0 | 80 | no image | no image | — | Comparison |
| I-2 | S-1 | none | — | 100 | 100 | 100 | 1.12 | " |
| I-3 | " | A-1 | 1.0 | 100 | 100 | 120 | 1.12 | Invention |
| I-4 | " | " | 2.0 | 108 | 100 | 158 | 1.12 | " |
| I-5 | " | " | 7.0 | 123 | 110 | 280 | 1.18 | " |
| I-6 | " | " | 10.0 | 141 | 110 | 285 | 1.12 | " |

From the results of Table 1, the following conclusions can be drawn.

(1) The light-harvesting dye exercises no spectral sensitization on the emulsion when used alone (i.e., combined with no sensitizing dye). This result combined with the results of the adsorption test in Example 2 hereinafter given is consistent with non-adsorbability of the light-harvesting dye molecules onto the emulsion grains.

(2) In the system where a sensitizing dye is already present, remarkable spectral sensitization takes place in the shorter wavelength side by the addition of the light-harvesting dye (light-harvesting sensitization).

(3) The light-harvesting sensitization is particularly pronounced at the wavelength corresponding to the absorption region of the light-harvesting dye (500 nm).

(4) The sensitizing effect, particularly in improvement of white light sensitivity, is particularly conspicuous with the light-harvesting dye concentration in a gelatin binder being 2 mmol/dm$^3$ or more.

5) From the fact that no particular reduction in sensitivity is observed in the cases of exposure at 600 nm at which only the sensitizing dye contributes to sensitivity, it can be seen that the addition of the light-harvesting dye provides a stable maximum density without causing any adverse influences on developability.

As described above, spectral sensitization can be achieved and sensitivity to white light can be substantially increased by adding a non-adsorbable luminescent light-harvesting dye to a dispersion medium of a silver halide emulsion in a high concentration. The significant sensitizing effects produced by such a non-adsorbable dye are entirely novel and unanticipated from conventional photographic techniques.

EXAMPLE 2

Samples II-1 to II-3 were prepared in the same manner as in Example 1, except for replacing A-1 with A-47 or a comparative adsorbable dye B-1 or B-2 having the formulae shown below.

B-1:

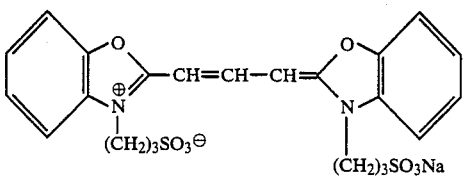

B-2:

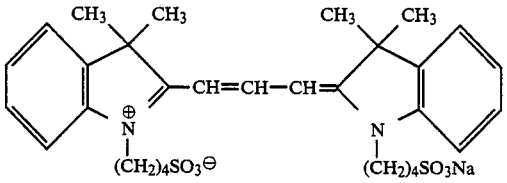

The light-harvesting dye A-47 had an emission yield of about 0.8 in a dry gelatin film at a concentration of $10^{-4}$ mol/dm$^3$. The maximum emission wavelength of A-1 or B-1 was 550 nm, and that of A-47 or B-2 was 585 nm.

Each of the samples was exposed and developed in the same manner as in Example 1, and the sensitivity results obtained in the same manner as in Example 1 are shown in Table 2 below. Table 2 also shows the adsorptions of the dyes as determined under the conditions specified in the present invention.

emulsion grains exercise remarkable sensitization through their light-harvesting effects, whereas the comparative dyes which have only two sulfo groups and are thereby adsorbable onto silver halide grains cause not only inhibition of dye sensitization (at 600 nm) but also inhibition of light-harvesting sensitization (at 500 nm).

EXAMPLE 3

In order to evaluate the sensitizing effects produced by the luminescence of dyes, Samples II-4 and II-5 were prepared in the same manner as in Example 1, except for replacing A-1 with general dyes P-1 and P-2 of formulae shown below, respectively.

P-1:

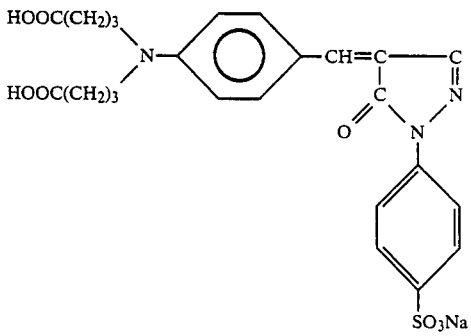

P-2:

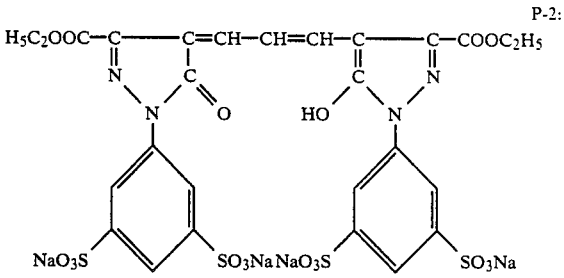

The samples were exposed and developed in the same manner as in Example 1, and the sensitivity results obtained in the same manner as in Example 1 are shown in Table 3 below. In Table 3, the sensitivity of a sample containing no light-harvesting dye was taken as a standard (100). The maximum absorption wavelength of P-1 or P-2 was 490 nm or 565 nm, respectively.

Although the dyes used in this example, P-1 and P-2, are water-soluble dyes having an adsorption in approximately the same wavelength region as those of A-1 and A-47, respectively, they exhibit very small emission yields as indicated in Table 3.

TABLE 2

| Sample No. | Sensitizing Dye | Light-Harvesting Dye: Kind | Light-Harvesting Dye: Concn. in Gelatin (mmol/dm$^3$) | Light-Harvesting Dye: Adsorption (mol/m$^2$) | Relative Sensitivity: White Light | Relative Sensitivity: 600 nm | Relative Sensitivity: 500 nm | Remark |
|---|---|---|---|---|---|---|---|---|
| I-2 | S-1 | none | — | — | 100 | 100 | 100 | Comparison |
| I-6 | " | A-1 | 10.0 | $10^{-8}$ | 141 | 110 | 285 | Invention |
| II-1 | " | B-1 | " | $1.1 \times 10^{-6}$ | 100 | 90 | 120 | Comparison |
| II-2 | " | A-47 | " | $10^{-8}$ | 112 | 100 | 151 | Invention |
| II-3 | " | B-2 | " | $1.2 \times 10^{-6}$ | 83 | 90 | 80 | Comparison |

As is apparent from Table 2, A-1 and A-47 according to the present invention which are not adsorbed on

TABLE 3

| Sample No. | Sensitizing dye | Light-Harvesting Dye: Kind | Light-Harvesting Dye: Concn. in Gelatin (mmol/dm$^3$) | Light-Harvesting Dye: Emission Yield | Relative Sensitivity: White Light | Relative Sensitivity: 500 nm | Relative Sensitivity: Blue Light* | Remark |
|---|---|---|---|---|---|---|---|---|
| II-4 | S-1 | P-1 | 10 | 0.02 | 89 | 56 | 100 | Comparison |

TABLE 3-continued

| Sample No. | Sensitizing dye | Light-Harvesting Dye Kind | Concn. in Gelatin (mmol/dm$^3$) | Emission Yield | Relative Sensitivity White Light | 500 nm | Blue Light* | Remark |
|---|---|---|---|---|---|---|---|---|
| II-5 | S-1 | P-2 | 10 | 0.05 | 80 | 50 | 95 | Comparison |

Note:
*Inherent region

As can be seen from Table 3 in view of Tables 1 and 2, the luminescent dyes according to the present invention produce satisfactory sensitizing effects, while P-1 and P-2, having poor luminescent properties, cause considerable desensitization in their absorption regions leading to reduction of sensitivity to white light, though they do not cause inherent desensitization due to adsorption and the like.

The desensitization caused by P-1 and P-2 is the same phenomenon as commonly observed in the cases of adding a photographic filter dye and is attributed to the filter effects of the dyes.

In marked contrast to these general dyes, dyes exhibiting luminescent properties so as to be effective in energy transfer, such as the light-harvesting dyes according to the present invention, achieve sensitization in their absorption regions, as is apparent from a comparison between Tables 2 and 3.

EXAMPLE 4

An octahedral silver iodobromide emulsion (iodine content: 2 mol %; mean grain size: 0.8 μm) was prepared in the presence of ammonia according to a double jet method. The emulsion was chemically sensitized with chloroauric acid and sodium thiosulfate. To the emulsion was added a sensitizing dye (S-2), (S-3), (S-4) or (S-5) each being different in sensitive wavelength region, in an amount of $3\times10^{-4}$ mol per mol of silver. Then, 4-hydroxy-6-methyl-1,3,3a,7-tetraazaindene was added thereto as a stabilizer in an amount of $2\times10^{-3}$ mol per mol of silver.

S-2

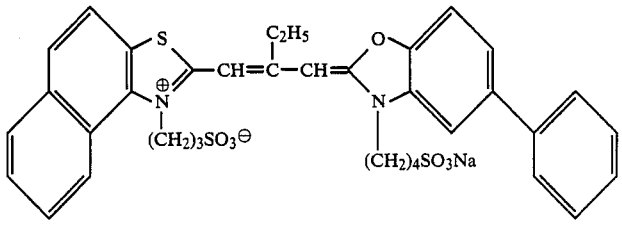

S-3

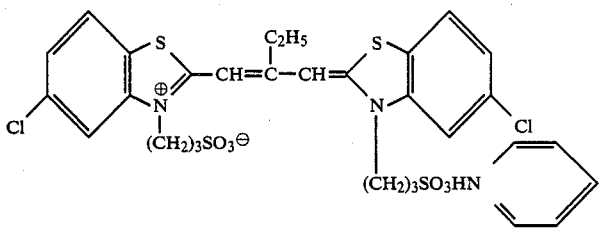

S-4

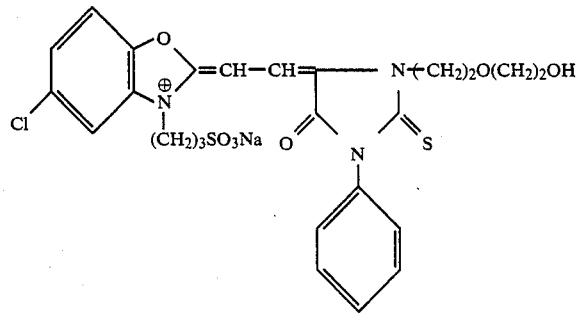

-continued

S-5

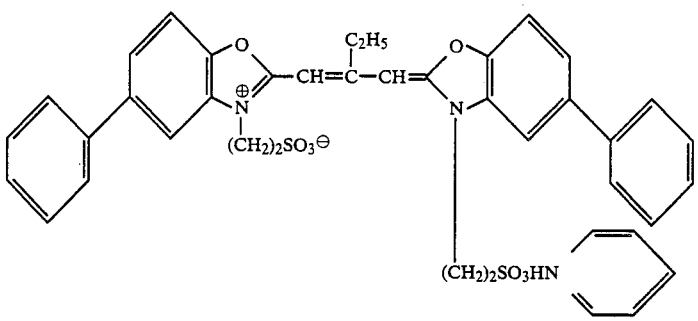

To the spectrally sensitized emulsion was further added 10 mmol/dm$^3$ of A-47.

The resulting coating composition was uniformly coated on a support and dried in the same manner as in Example 1. The resulting samples were designated as III-1 to III-4.

Each of these samples was exposed and developed in the same manner as in Example 1, and the sensitivity results obtained in the same manner as in Example 1 are shown in Table 4. below. In Table 4, the sensitivity of a sample containing no light-harvesting dye was taken as a standard (100).

TABLE 4

| Sample No. | Sensitizing Dye Kind | Sensitizing Dye Max. Absorption Wavelength | Light-Harvesting Dye Kind | Light-Harvesting Dye Emission Peak Wavelength | Relative Sensitivity White Light | Relative Sensitivity 520 nm | Remarks |
|---|---|---|---|---|---|---|---|
| III-1 | S-2 | 600 nm | A-47 | 585 nm | 126 | 141 | Invention |
| III-2 | S-3 | 645 nm | " | " | 115 | 126 | " |
| III-3 | S-4 | 530 nm | " | " | 32 | 30 | Comparison |
| III-4 | S-5 | 540 nm | " | " | 42 | 45 | " |

As is apparent from the results of Table 4, Samples III-3 and III-4 in which the emission band of the light-harvesting dye and the absorption band of the sensitizing dye do not substantially overlap with each other suffer significant desensitization, while Samples III-1 and III-2 in which the above-described emission band and absorption band show a satisfactory overlap demonstrate marked sensitizing effects.

Thus, marked sensitizing effects of the light-harvesting dye are exhibited when the emission band thereof shows a good overlap over the absorption band of a sensitizing dye. If the emission band of the light-harvesting dye is outside of the absorption band of a sensitizing dye, the absorption of the light-harvesting dye produces filter effects causing desensitization.

In other words, the novel effects according to the present invention can first be presented to the highest degree by appropriately combining the emission wavelength region of the light-harvesting dye and the absorption wavelength region of the sensitizing dye.

EXAMPLE 5

An inner latent image type direct positive emulsion comprising mono-dispersed octahedral silver bromide grains (mean grain size: 1.5 μm) was prepared in accordance with the method described in Example 1 of Japanese Patent Application (OPI) No. 95533/85. To 80 g of the emulsion (silver content: 5 g; gelatin content: 8 g) was added 10 ml of a $10^{-3}$M solution of a sensitizing dye (S-2) used in Example 3 to effect spectral sensitization. Then, 35 mg of 4-hydroxy-6-methyl-1,3,3a,7-tetraazaindene was added thereto as a stabilizer. To the emulsion was further added $6\times10^{-5}$ mol of A-2 or A-10 (concentration in a dry gelatin film: 10 mmol/dm$^3$). The emission yield of A-2 or A-10 in gelatin was about 0.9.

A generally employed coating aid and $1.0\times10^{-6}$ mol of a nucleating agent shown below were further added to the emulsion, and the resulting coating composition was coated on a triacetyl cellulose support and dried to prepare a direct positive light-sensitive material having a silver coverage of 4.2 g/m$^2$ and a gelatin coverage of 5.5 g/m$^2$. The resulting samples were designated as V-2 and V-3. Nucleating Agent:

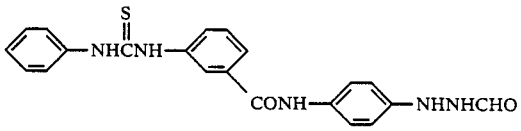

For comparison, Sample V-1 was prepared in the same manner as for V-2 and V-3, except for using no light-harvesting dye.

Each of V-1 to V-3 was wedgewise exposed to light under the same conditions as in Example 1 and then developed at 20° C. for 8 minutes with a surface developer having the following formulation to obtain a direct positive.

| Surface Developer Formulation: | |
|---|---|
| Sodium sulfite | 60 g |
| Hydroquinone | 20 g |
| 1-Phenyl-4-methyl-4-hydroxymethyl-3-pyrazolidone | 1.5 g |
| Sodium tertiary phosphate dodecahydrate | 80 g |
| Sodium hydroxide | 21 g |
| 5-Methylbenzotriazole | 0.1 g |
| Water to make | 2000 ml |

The sensitivity of the resulting positive image is shown in Table 5 below. In Table 5, the sensitivity of V-1 containing no light-harvesting dye was taken as a standard (100).

TABLE 5

| Sample No. | Sensitizing Dye | Light-Harvesting Dye | Relative Sensitivity White Light | Relative Sensitivity 500 nm | Remark |
|---|---|---|---|---|---|
| V-1 | S-2 | — | 100 | 100 | Comparison |
| V-2 | S-2 | A-2 | 115 | 180 | Invention |
| V-3 | S-2 | A-10 | 110 | 170 | Invention |

It is apparent from Table 5 that the samples according to the present invention exhibit markedly increased, sensitivity in the absorption wavelength region of A-2 or A-10 (500 nm) and the positive sensitivity to white light is thereby improved as compared with the comparative sample.

EXAMPLE 6

In order to examine removability of dyes in a binder by washing, Samples VI-1 to VI-7 containing each of the light-harvesting dyes of the present invention (A-1 and A-47), the comparative dyes used in Example 2 (B-1 and B-2), and comparative dyes shown below (C-1, C-2 and C-3) in a concentration of 10 mmol,/dm$^3$ in dry gelatin were prepared. The gelatin coverage was 4.0 g/m$^2$ in each sample.

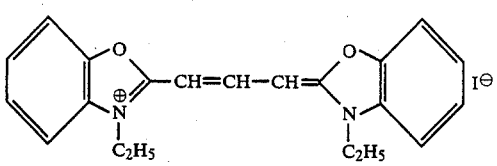

C-1

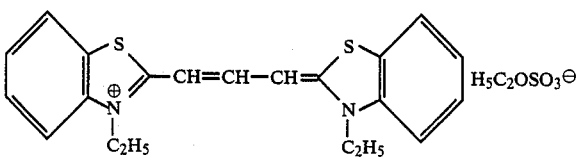

C-2

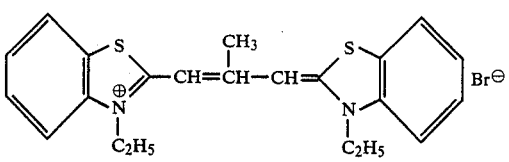

C-3

Each of the samples was cut to a size 3 cm square, and the piece was immersed in 1 l of water containing 1 g of potassium bromide at 20° C. while stirring to compare the rate of dye elution into the aqueous phase. The removability of the dye was evaluated by measuring (a) the time of immersion (sec.) required for the color density retension of the sample piece to become 5% or less or (b) the color retension (%) after 10 minutes' immersion. The results obtained are shown in Table 6 below.

TABLE 6

| Sample No. | Dye | Absorption* (mol/m$^2$) | Dye Removability | Remark |
|---|---|---|---|---|
| VI-1 | A-1 | $10^{-8}$ | (a) 25 sec. | Invention |
| VI-2 | A-47 | $10^{-8}$ | (a) 20 sec. | " |
| VI-3 | B-1 | $1.1 \times 20^{-6}$ | (a) 50 sec. | Comparison |
| VI-4 | B-2 | $1.2 \times 10^{-6}$ | (a) 45 sec. | " |
| VI-5 | C-1 | $2 \times 10^{-6}$ | (b) 27% | " |
| VI-6 | C-2 | $2 \times 10^{-6}$ | (b) 24% | " |
| VI-7 | C-3 | $2 \times 10^{-6}$ | (b) 36% | " |

Note:
*Determined at an equilibrium concentration of $10^{-4}$ mol/l.

It can be seen from Table 6 that both A-1 and A-47 which are non-adsorbable cyanine dyes having four water-soluble groups per molecule can be rapidly decolored within 25 seconds, whereas B-1 and B-2 which are weakly adsorbable dyes having two sulfo groups (see Example 2) shown slower decoloration. It can further be confirmed that C-1, C-2 and C-3 which contain no sulfo group and are, therefore, poor in water solubility retain their colors to considerable degrees even after immersion for 10 minutes, showing difficulty in decoloration.

From these results, it is apparent that the watersoluble and non-adsorbable light-harvesting dyes according to the present invention in a gelatin binder can be removed rapidly in an aqueous solution and do not cause color retension. sion.

EXAMPLE 7

One liter of an aqueous solution containing 200 g of silver nitrate and 1 l of an aqueous solution containing 150 g of potassium bromide were simultaneously added to 1 l of an aqueous solution containing 15 g of inert gelatin at 35° C. with stirring at constant feed rate over a period of 20 minutes while maintaining a pBr value at 2.20 to prepare an emulsion comprising cubic pure silver bromide grains having a mean side length of 0.073 μm. After washing with water by a sedimentation method, an additional amount of gelatin was added to the emulsion, and the emulsion was subjected to chemical sensitization using triethylthiourea and chloroauric acid. The resulting emulsion weighed 1500 g and contained 95 g of gelatin and 200 g of silver on a silver nitrate conversion.

To 23 g of the emulsion were added 23 g of a 10 wt % gelatin aqueous solution, 50 mg of 4-hydroxy-6-methyl-1,3,3a,7-tetraazaindene, $2\times10^{-5}$ mol of dye (S-2), a light-harvesting dye (A-47) in the amount indicated in Table 7, and a coating aid. The thus prepared coating composition was coated on a cellulose acetate support and dried to obtain a light-sensitive material containing 1.25 g/m$^2$ of silver and 2.3 g/m$^2$ of gelatin. The resulting samples were designated as VII-1 to VII-5.

Each of the samples was wedgewise exposed to light emitted from a light source having a color temperature of 4800° K. through a SC 48 filter (referred to hereafter as Minus Blue exposure) or an interference filter for exposure to monochromatic light of 561 nm which was near the absorption peak of A-47 in dry gelatin. The exposed sample was developed with the same developer as used in Example 1 at 20° C. for 10 minutes, fixed, washed, and dried. Table 7 below shows the relative sensitivity of the samples under Minus Blue exposure or monochromatic light exposure with the content of A-47 being varied. In Table 7, the relative sensitivity means a relative value of a reciprocal of an exposure providing an optical density of fog +0.1, taking the value of VII-1 containing no light-harvesting dye as a standard (100).

TABLE 7

| Sample No. | Concn. of A-47 in Dry Gelatin (mmol/dm$^3$) | Relative Sensitivity | | Remark |
|---|---|---|---|---|
| | | Minus Blue | 561 nm | |
| VII-1 | 0 | 100 | 100 | Comparison |
| VII-2 | 7.05 | 141 | 170 | Invention |
| VII-3 | 14.1 | 151 | 214 | " |
| VII-4 | 28.2 | 170 | 234 | " |
| VII-5 | 56.4 | 170 | 234 | " |

Table 7 reveals that photographic sensitivity is markedly increased with an increase of concentration of the light-harvesting dye A-47.

EXAMPLE 8

Samples VIII-1 to VIII-6 were prepared in the same manner as Sample VII-4 of Example 7 (A-47 concentration; 28.2 mmol/dm$^3$), except that the sensitizing dye (S-2) used in VII-4 was replaced with 1.16 mmol/mol of Ag of each of spectral sensitizing dyes S-3 (see Example 4), and S-6 to S-10 (shown below) which were adsorbable onto silver halide grains and whose absorption wavelength showed a good overlap in the emission wavelength region of A-47 (emission peak: 586 nm) in dry gelatin containing a given amount (28.2 mmol/dm$^3$) of A-47. For comparison, comparative samples were prepared in the same manner as Samples VIII-1 to VIII-6, respectively, except for containing no light-harvesting dye (A-47).

Each of the samples was exposed and developed in the same manner as in Example 7, and the sensitivity obtained for the sample according to the present invention was compared with that of the corresponding comparative sample containing no light-harvesting dye to determine the rate of increase in sensitivity. The results obtained are shown in Table 8.

TABLE 8

| Sample No. | Sensitizing Dye | Sensitivity Increase Rate | | Remark |
|---|---|---|---|---|
| | | Minus Blue (%) | 561 nm (%) | |
| VIII-1 | S-6 | 41 | 35 | Invention |
| VIII-2 | S-7 | 70 | 145 | " |
| VIII-3 | S-8 | 55 | 124 | " |
| VIII-4 | S-9 | 48 | 95 | " |
| VIII-5 | S-10 | 51 | 95 | " |
| VIII-6 | S-3 | 86 | 390 | " |

The sensitizing dyes S-6 to S-10 used in the sample preparation are as follows.

S-6

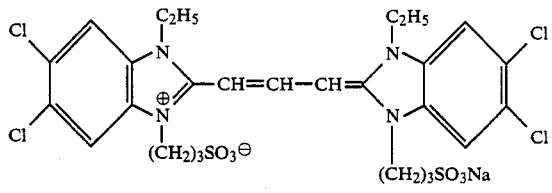

S-7

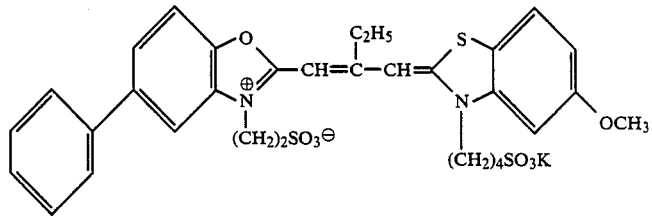

S-8

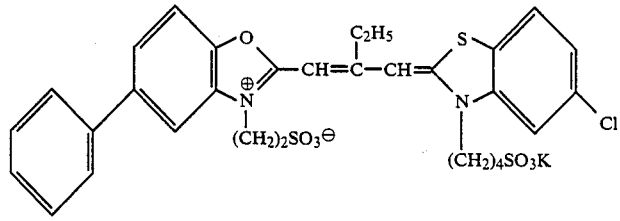

-continued

S-9

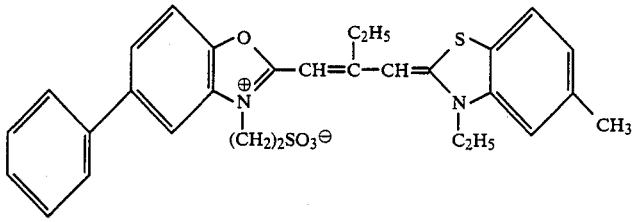

S-10

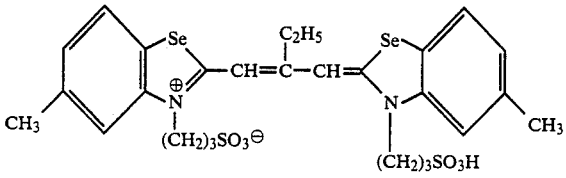

The results of Example 8 and Example 9 equally show significant improvement in the spectral sensitivity by the use of the light-harvesting dyes A-47 and A-1, respectively, with respect to various kinds of the co-existing sensitizing dyes.

EXAMPLE 9

A light-sensitive material was prepared in the same manner as in Example 8, except for replacing A-47 with 56.4 mmol/dm$^3$ of A-1 and using 1.16 mmol/mol of Ag of a spectral sensitizing dye (S-11) having the formula shown below.

S-11

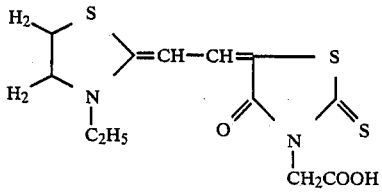

As a result of determining a relative sensitivity in the same manner as in Example 8, the sensitivity to Minus Blue was found to be increased by 32%.

EXAMPLE 10

A 0.235N silver nitrate aqueous solution and a 0.235N potassium bromide aqueous solution were simultaneously added to 24 l of an aqueous solution containing 144 g of potassium bromide and 190 g of inert gelatin at 30° C. at the same feed rate of 800 ml/min. for 16 seconds while stirring well. Thereafter, 5.3 l of a 10 wt % gelatin aqueous solution was added thereto, and the temperature was raised to 75° C. Subsequently, a 0.235N silver nitrate aqueous solution was added thereto at a feed rate of 140 ml/min. for 28 minutes. A 1.47N silver nitrate aqueous solution and a 1.47N potassium bromide aqueous solution were each simultaneously added to the system at the same feed rate increasing from 24 ml/min. to 456 ml/min. over a period of 60 minutes while maintaining a pBr value at 2.0 until 14.4 l of the silver nitrate aqueous solution was added.

Immediately thereafter, the resulting emulsion was cooled to 35° C. and washed with water by a flocculation method. To the emulsion were added 2160 g of gelatin and 1100 ml of 5 wt % phenol aqueous solution, and the pH was adjusted to 6.5 with a 1N sodium hydroxide aqueous solution to finally obtain an emulsion weighing 30 Kg.

The resulting emulsion was found to comprise mono-dispersed tabular silver bromide grains having a mean projected diameter (a diameter of a circle having the same area as the projected area of the main plane) of 2.3 μm, a coefficient of variation in projected diameter distribution of 12.2%, and a mean thickness of 0.16 μm (aspect ratio: 14.4).

The emulsion was chemically sensitized with 1.4 ml of a 0.01 wt % sodium thiosulfate aqueous solution, 1.4 ml of a 0.1 wt % potassium thiocyanate aqueous solution, and 1.4 ml of a 0.01 wt % chloroauric acid aqueous solution each per 100 g of the emulsion at 60° C. for 60 minutes. To 30 g of the thus sensitized emulsion were added 25 g of a 10 wt % gelatin aqueous solution, $8.0\times10^{-6}$ mol of a spectral sensitizing dye (S-2), and a light-harvesting dye (A-47) in the concentration indicated in Table 9 below. Ater a hardening agent and a coating aid were added, the emulsion was coated on a support and dried to obtain a silver halide light-sensitive material having a silver coverage of 1.70 g/m$^2$ and a gelatin coverage of 3.64 g/m$^2$. The thus prepared samples were designated as X-1 to X-4.

Each of X-1 to X-4 was exposed and developed in the same manner as in Example 7, and the sensitivity to Minus Blue and monochromatic light of 561 nm were determined. The results obtained are shown in Table 9. In Table 9, the sensitivity of X-1 containing no A-47 was taken as a standard (100).

TABLE 9

| Sample No. | Concn. of A-47 in Dry Gelatin (mmol/dm$^3$) | Relative Sensitivity Minus Blue | Relative Sensitivity 561 nm | Remark |
|---|---|---|---|---|
| X-1 | 0 | 100 | 100 | Comparison |
| X-2 | 7 | 105 | 117 | Invention |
| X-3 | 14 | 110 | 123 | " |
| X-4 | 28 | 126 | 151 | " |

The results of Table 9 prove that the effects of the light-harvesting dye according to the present invention are markedly exercised on light-sensitive materials containing mono-dispersed tabular silver halide grains as well as on light-sensitive materials containing octahedral and cubic silver halide grains.

EXAMPLE 11

A 1.88N silver nitrate aqueous solution and a 1.95N potassium bromide aqueous solution were each added simultaneously to 1 l of an aqueous solution containing 7 g of inert gelatin, $1.2\times10^{-3}$ gram-equivalent of potassium hydroxide, and $3.78\times10^{-2}$ gram-equivalent of potassium bromide kept at 30° C. at the same feed rate of 25 ml/min. over a period of 66 seconds while stirring well.

To 350 ml of the resulting emulsion were added 650 ml of water, 25 g of gelatin, 4.3 ml of a 1N potassium hydroxide aqueous solution, and 5.0 ml of a 10 wt % potassium bromide aqueous solution. The temperature was elevated to 75° C., and the stirring was continued at that temperature for an additional 40 minutes. Subsequently, a 2.94N silver nitrate aqueous solution and a 2.94N potassium bromide aqueous solution was each added simultaneously to the emulsion at the same feed rate of 6 ml/min. over a period of 10 minutes, than at 12 ml/min. for 20 minutes, and finally at 20 ml/min. for 20 minutes, while maintaining the pBr value at 1.90.

Immediately thereafter, the emulsion was quenched to 30° C. and washed with water according to a flocculation method. To the emulsion was added 222 g of gelatin, the pH was adjusted to 6.5, and water was added thereto to make 2800 g as a final yield.

The resulting emulsion was found to comprise mono-dispersed tabular silver bromide grains having a mean projected diameter of 1.4 μm, a coefficient of variation of projected diameter distribution of 11.0%, and a mean thickness of 0.20 μm (aspect ratio: 7.0). The emulsion was then chemically sensitized with 1.4 ml of a 0.01 wt % sodium thiosulfate aqueous solution, 1.4 ml of a 0.1 wt % potassium thiocyanate aqueous solution, and 1.4 ml of a 0.01 wt % chloroauric acid aqueous solution each per 100 g of the emulsion at 60° C. for 60 minutes.

To 30 g of the thus sensitized emulsion were added 25 g of a 10 wt % gelatin aqueous solution, $8.0\times10^{-6}$ mol of spectral sensitizing dye (S-2), light-harvesting dye (A-47) in the concentration indicated in Table 10, a hardening agent, and a coating aid to prepare a coating composition. The composition was coated on a support and dried to obtain a silver halide light-sensitive material having a silver coverage of 1.70 g/m$^2$ and a gelatin coverage of 3.64 g/m$^2$. The resulting samples were designated as XI-1 to XI-4.

Each of XI-1 to XI-4 was exposed and developed in the same manner is in Example 7, and the relative sensitivities to Minus Blue and monochromatic light of 561 nm were determined. The results obtained are shown in Table 10. In Table 10, the sensitivity of XI-1 containing no light-harvesting dye was taken as a standard (100).

TABLE 10

| Sample No. | Concn. of A-47 in Dry Gelatin (mmol/dm$^3$) | Relative Sensitivity Minus Blue | Relative Sensitivity 561 nm | Remark |
|---|---|---|---|---|
| XI-1 | 0 | 100 | 100 | Comparison |
| XI-2 | 7 | 110 | 115 | Invention |
| XI-3 | 14 | 117 | 121 | " |
| XI-4 | 28 | 125 | 148 | " |

It can be seen from Table 10 that the effects of the light-harvesting dye according to the present invention are exercised on light-sensitive materials containing mono-dispersed tabular silver halide grains as well.

EXAMPLE 12

One liter of an aqueous solution containing 200 g of silver nitrate and 1 l of an aqueous solution containing 70 g of sodium chloride were simultaneously added to 1 l of an aqueous solution containing 15 g of inert gelatin at 35° C. at the same constant feed rate for a period of 20 minutes while keeping the pCl value at 2.0 while thoroughly stirring. The resulting emulsion was found to contain cubic pure silver chloride grains having a mean side length of 0.13 μm. After washing with water by a sedimentation method, gelation was added thereto. The emulsion was then chemically sensitized with triethylthiourea. The resulting emulsion weighed 1500 g and contained 95 g of gelatin and 200 g of silver on a silver nitrate conversion. This emulsion was designated as Emulsion A.

One liter of an aqueous solution containing 200 g of silver nitrate and 1 l of a mixed halogen aqueous solution containing 98 g of potassium bromide and 21.2 g of sodium chloride were each added simultaneously to 1 l of an aqueous solution containing 15 g of inert gelatin and 6.7 g of sodium chloride at 60° C. at the same constant feed rates while keeping the pCl value at 2.0 under thorough stirring.

The resulting emulsion was found to comprise substantially cubic silver chlorobromide grains having a mean side length of 0.50 μm. After washing with water by a sedimentation method, gelatin was added to the emulsion, and the emulsion was chemically sensitized with triethylthiourea. The thus prepared emulsion weighed 1500 g and contained 95 g of gelatin and 200 g of silver on a silver nitrate conversion. This emulsion was designated as Emulsion B.

To 500 ml of an aqueous solution containing 200 g of silver nitrate was slowly added 240 ml of 10M aqueous ammonia, and water was added to the mixture to make one liter. One liter of the resulting silver-ammonia complex aqueous solution and 1 l of a mixed halogen aqueous solution containing 11.7 g of potassium iodide and 153 g of potassium bromide were added simultaneously to 1 l of an aqueous solution containing 20 g of inert gelatin and 10 g of potassium bromide at 60° C. under thorough stirring to prepare an emulsion comprising twin silver iodobromide grains having a nearly spherical form of 0.60 μm in mean projected diameter. After washing with water by a sedimentation method, gelatin was added thereto. The emulsion was chemically sensitized with triethylthiourea and chloroauric acid. The resulting emulsion weighed 1500 g and containing 95 g of gelatin and 200 g of silver on a silver nitrate conversion. This emulsion was designated as Emulsion C.

To 23 g of each of Emulsions A, B and C were added 23 g of a 10 wt % gelatin aqueous solution, 50 mg of 4-hydroxy-6-methyl-1,3,3a,7-tetraazaindene, 2 spectral sensitizing dye (S-2), $8\times10^{-5}$ mol of light-harvesting dye (A-47), and a coating aid to prepare a coating composition. The composition was coated on a cellulose acetate support and rried to obtain a silver halide light-sensitive material having a silver coverage of 1.25 g/m$^2$ and a gelatin coverage of 2.3 g/m$^2$. The resulting samples were designated as VII-1 to VII-3.

Each of VII-1 to VII-3 was wedgewise exposed to light emitted from a light source having a color temperature of 2854° K. through an interference filter transmitting monochromatic light of 561 nm which was near the absorption peak of A-47 in dry gelatin. The exposed sample was developed with the same developer as used in Example 1 at 20° C. for 10 minutes, fixed, washed with water, and dried. The photographic sensitivity of the developed sample was determined, and the results obtained are shown in Table 11 below. In Table 11, the sensitivity means a reciprocal of an exposure providing an optical density of fog +0.1 and is relatively expressed taking the sensitivity of the corresponding sample containing no light-harvesting dye (A-47) as a standard (100).

TABLE 11

| Sample No. | Emulsion | Relative Sensitivity to Light of 561 nm |
|---|---|---|
| XII-1 | A | 245 |
| XII-2 | B | 190 |
| XII-3 | C | 192 |

As can be seen from Table 11, the light-harvesting sensitization effects according to the present invention can be observed in any type of silver halide emulsions.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one silver halide emulsion layer spectrally sensitized with an adsorbable spectral sensitizing dye, wherein a hydrophilic dispersion medium contains a substantially non-adsorbable luminescent dye which is easily removably by development processing and satisfies the following conditions (1) to (4):

(1) the luminescent dye has an equilibrium adsorption of not more than $5\times10^{-7}$ mol per $m^2$ of silver bromide grain surface in a 5% by weight gelatin aqueous solution contianing silver bromide grains whose outer surface is composed substantially of a face under conditions of a 40° C. in temperature, 6.5 ±0.05 in pH, and $10^{-4}$ mol/l in dye concentration in the solution phase;

(2) the luminescent dye has an emission quantum yield of not less than 0.1 at room temperature in dry gelatin at a concentration of $-10^{-4}$ mol/dm3;

(3) the luminescent dye has an emission band at least a part of which overlaps an optical absorption band of the adsorbable spectral sensitizing dye on silver halide grains; and (4) the luminescent dye is one which absorbs light and luminesces in the visible region.

2. A silver halide photographic material as claimed in claim 1, wherein said absorbable spectral sensitizing dye is selected from merocyanine dyes, cyanine dyes having at least one of thiazole, selenazole, quinoline, and indolenine nuclei, and cyanine dyes having at least two oxazole nuclei or at least two imidazole nuclei.

3. A silver halide photographic material as claimed in claim 1, wherein said luminescent dye has water solubility of not less than $10^{-2}$ mol/l at 25° C. and a pH of 7.0.

4. A silver halide photographic material as claimed in claim 1, wherein said luminescent dye has an equilibrium adsorption of not more than $10^{-7}$ mol per $m^2$ of silver bromide grain surface in a 5% by weight gelatin aqueous solution containing silver bromide grains whose outer surface is composed substantially of a face under conditions of 40° C. in temperature, 6.5 ±0.05 in pH, and $10^{-4}$ mol/l in dye concentration in the solution phase.

5. A silver halide photographic material as claimed in claim 1, wherein said luminescent dye has an emission quantum yield of not less than 0.3 at room temperature in dry gelatin at a concentration of $10^{-4}$ mol/$dm^3$.

6. A silver halide photographic material as claimed in claim 1, wherein said luminescent dye has an emission quantum yield of not less than 0.5 at room temperature in dry gelatin at a concentration of $10^{-4}$ mol/$dm^3$.

7. A silver halide photographic material as claimed in claim 1, wherein said luminescent dye has a maximum absorption wavelength of from 420 nm to 740 nm in the photographic material.

8. A silver halide photographic material as claimed in claim 6, wherein said luminescent dye has a concentration of not less than $2\times10^{-3}$ mol/$dm^3$ in the hydrophilic dispersion medium.

9. A silver halide photographic material as claimed in claim 8, wherein said luminescent dye has a concentration of not more than $10^{-1}$ mol/$dm^3$ in the hydrophilic dispersion medium.

10. A silver halide photographic material as claimed in claim 1, wherein said luminescent dye is a water-soluble cyanine dye containing at least four water-soluble groups selected from sulfo and carboxyl groups.

11. A silver halide photographic material as claimed in claim 10, wherein said luminescent dye has an emission quantum yield of not less than 0.5 at room temperature in dry gelatin at a concentration of $10^{-4}$ mol/$dm^3$.

12. A silver halide photographic material as claimed in claim 1, wherein said luminescent dye has a maximum emission wavelength which does not exceed the maximum absorption wavelength of an adsorbable spectral sensitizing dye whose absorption wavelength is at the longest of those of the adsorbable spectral sensitizing dyes adsorbed on the silver halide grains.

13. A silver halide photographic material as claimed in claim 1, wherein said luminescent dye has a Stokes' shift of emission within 40 nm in dry gelatin at a concentration of $10^{-4}$ mol/$dm^3$ at room temperature.

14. A silver halide photographic material as claimed in claim 13, wherein said luminescent dye has a Stokes' shift of emission within 20 nm in dry gelatin at a concentration of $10^{-4}$ mol/$dm^3$ at room temperature.

15. A silver halide photographic material as claimed in claim 1, wherein said luminescent dye has a reduced potential of less than −1.0 V with reference to a saturated calomel electrode in a water/ethanol (1:1 by volume) solution.

* * * * *